US007621614B2

(12) United States Patent
Endo

(10) Patent No.: US 7,621,614 B2
(45) Date of Patent: Nov. 24, 2009

(54) PRINTING APPARATUS AND PRINTING SYSTEM WITH A PLURALITY OF MOVABLE SENSORS FOR A PLURALITY OF FEATURES DETECTION

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/563,877

(22) PCT Filed: Jul. 29, 2004

(86) PCT No.: PCT/JP2004/011201

§ 371 (c)(1),
(2), (4) Date: Jan. 9, 2006

(87) PCT Pub. No.: WO2005/016648

PCT Pub. Date: Feb. 24, 2005

(65) Prior Publication Data

US 2006/0158472 A1 Jul. 20, 2006

(30) Foreign Application Priority Data

Aug. 15, 2003 (JP) ..... 2003-293922
Aug. 15, 2003 (JP) ..... 2003-293923

(51) Int. Cl.
*B41J 29/393* (2006.01)

(52) U.S. Cl. ..... 347/19

(58) Field of Classification Search ..... 347/19, 347/95, 101, 104

See application file for complete search history.

(56) References Cited

U.S. PATENT DOCUMENTS

| | | | | |
|---|---|---|---|---|
| 4,983,854 | A * | 1/1991 | Mizuno et al. | 250/559.15 |
| 5,139,339 | A | 8/1992 | Courtney et al. | |
| 5,812,152 | A | 9/1998 | Torigoe et al. | |
| 5,898,443 | A * | 4/1999 | Yoshino et al. | 347/19 |
| 6,215,557 | B1 * | 4/2001 | Owens | 358/1.14 |
| 6,332,663 | B1 * | 12/2001 | Puzio | 347/19 |
| 6,378,976 | B1 * | 4/2002 | Byers et al. | 347/19 |
| 6,386,669 | B1 | 5/2002 | Scofield et al. | |
| 6,454,383 | B2 * | 9/2002 | Lund et al. | 347/19 |
| 6,517,180 | B2 * | 2/2003 | Tullis et al. | 347/19 |
| 6,527,360 | B2 * | 3/2003 | Otsuki et al. | 347/19 |
| 6,622,625 | B1 | 9/2003 | Sugiyama | |

(Continued)

FOREIGN PATENT DOCUMENTS

CN 1371325 A 9/2002

(Continued)

OTHER PUBLICATIONS

Examination Report from European Patent Office for Application No. 04 771 228.6-1251.

*Primary Examiner*—Manish S Shah
*Assistant Examiner*—Rene Garcia, Jr.
(74) *Attorney, Agent, or Firm*—Sughrue Mion, PLLC

(57) ABSTRACT

A printing apparatus according to the present invention includes a movable head that performs recording on a medium using ink; a first sensor that can move together with said head and that detects regular reflection light from said medium; and a second sensor that is provided separately from said first sensor, that can move together with said head and that detects diffuse reflection light from said medium.

21 Claims, 29 Drawing Sheets

U.S. PATENT DOCUMENTS

| | | | | |
|---|---|---|---|---|
| 7,101,017 | B2 * | 9/2006 | Endo et al. | 347/19 |
| 7,182,424 | B2 * | 2/2007 | Kubota | 347/19 |
| 7,198,349 | B2 * | 4/2007 | Endo et al. | 347/19 |
| 7,285,771 | B2 * | 10/2007 | Walker | 250/239 |
| 7,318,637 | B2 * | 1/2008 | Ishimoto et al. | 347/19 |
| 7,354,127 | B2 * | 4/2008 | Endo | 347/19 |
| 2002/0175970 | A1 * | 11/2002 | Arai et al. | 347/33 |

FOREIGN PATENT DOCUMENTS

| | | | |
|---|---|---|---|
| EP | 1 213 150 | A1 | 6/2002 |
| JP | 02-078585 | A | 3/1990 |
| JP | 2-78585 | A | 3/1990 |
| JP | 04-028552 | A | 1/1992 |
| JP | 8-137034 | A | 5/1996 |
| JP | 2001-105578 | A | 4/2001 |
| JP | 2002-103721 | A | 4/2002 |
| JP | 2002-137509 | A | 5/2002 |
| JP | 3 089 578 | U | 8/2002 |
| JP | 3089578 | U | 8/2002 |

* cited by examiner

PRINTING APPARATUS AND PRINTING SYSTEM WITH A PLURALITY OF MOVABLE SENSORS FOR A PLURALITY OF FEATURES DETECTION

TECHNICAL FIELD

The present application claims priority upon Japanese Patent Application No. 2003-293922 and Japanese Patent Application No. 2003-293923 filed on Aug. 15, 2003, which are herein incorporated by reference.

The present invention relates to printing apparatuses and printing systems.

BACKGROUND ART

Inkjet printers are known as an example of printing apparatuses that carry out printing by ejecting ink onto various media such as paper, cloth, and film. Such inkjet printers comprise a carry unit that carries the paper in the carrying direction, and a movable head that performs recording on the medium using ink.

Furthermore, an inkjet printer has been proposed that is provided with a sensor that can be moved together with the head (JP 2002-103721A). Since this sensor is movable, the detection position of the sensor can be changed, and various features within the inkjet printer can be detected.

But when there is only one movable sensor, the features that can be detected are limited. Furthermore, when trying to detect many features with one sensor, it becomes impossible to detect those features at the optimum detection position. Moreover, when trying to detect many features with one sensor, a very sophisticated sensor must be employed.

Accordingly it is a first object of the present invention to provide different types of movable sensors and to increase the number of features that can be detected. It is a second object of the present invention to provide two movable sensors and to split the features to be detected.

DISCLOSURE OF INVENTION

A first invention for attaining the above-described object includes a movable head that performs recording on a medium using ink; a first sensor that can move together with said head and that detects regular reflection light from said medium; and a second sensor that is provided separately from said first sensor, that can move together with said recording head and that detects diffuse reflection light from said medium.

A second invention for attaining the above-described object includes a carry unit that carries a medium in a carrying direction; a movable head that performs recording on a medium using ink; a first sensor that can move together with said head and that detects an edge of said medium; and a second sensor that can move together with said head and that detects a pattern formed on said medium by said head; wherein said first sensor is provided further upstream with regard to said carrying direction than said second sensor.

It should be noted that the present invention can also be viewed from other angles. Other features of the present invention will become clear through the accompanying drawings and the description of the present specification.

27C is an explanatory diagram of the test result of the downstream-side optical sensor for the case that there is a non-ejecting nozzle.

Figure 28A:
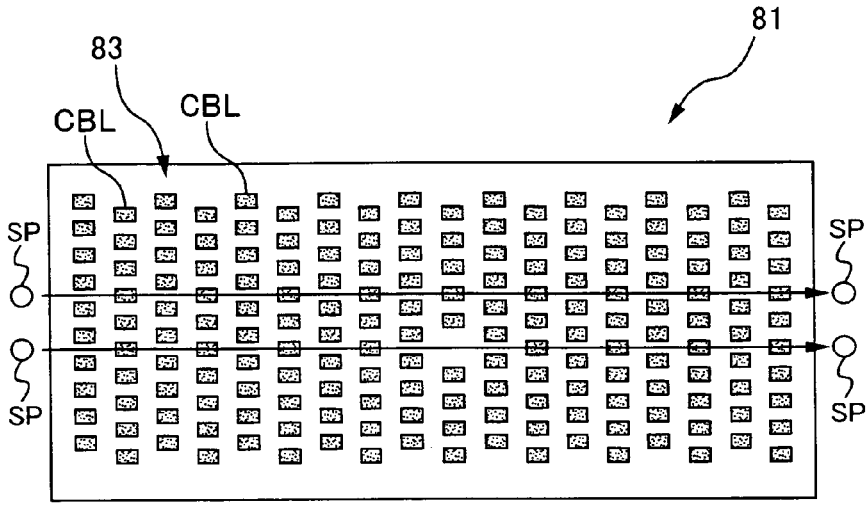
Figure 28B:
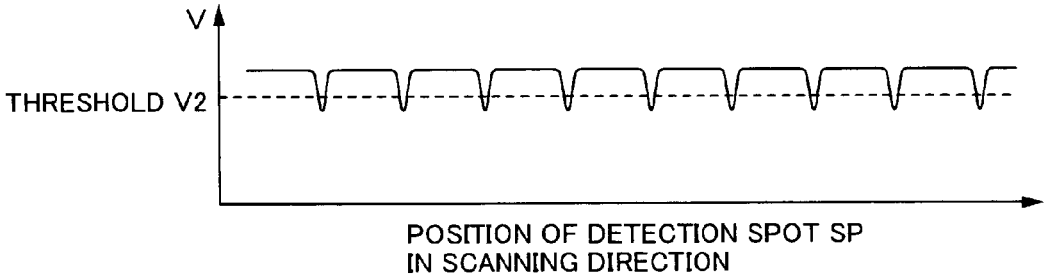
Figure 28C:
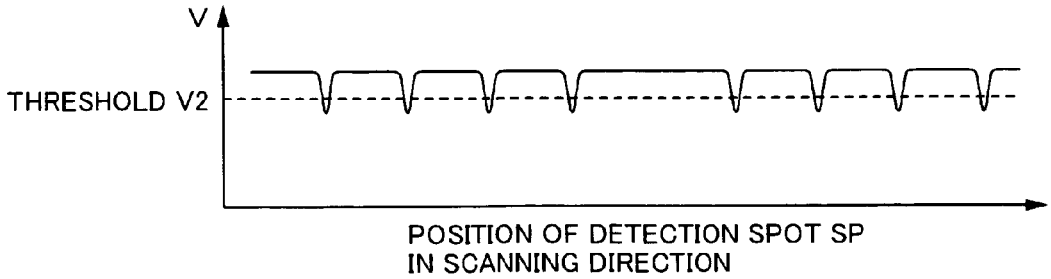

FIG. 28A is an explanatory diagram illustrating the inspection of the colored ink test pattern. FIG. 28B is an explanatory diagram of the test result of the downstream-side optical sensor for the case that there is no non-ejecting nozzle. FIG. 28C is an explanatory diagram of the test result of the downstream-side optical sensor for the case that there is a non-ejecting nozzle.

Figure 29:
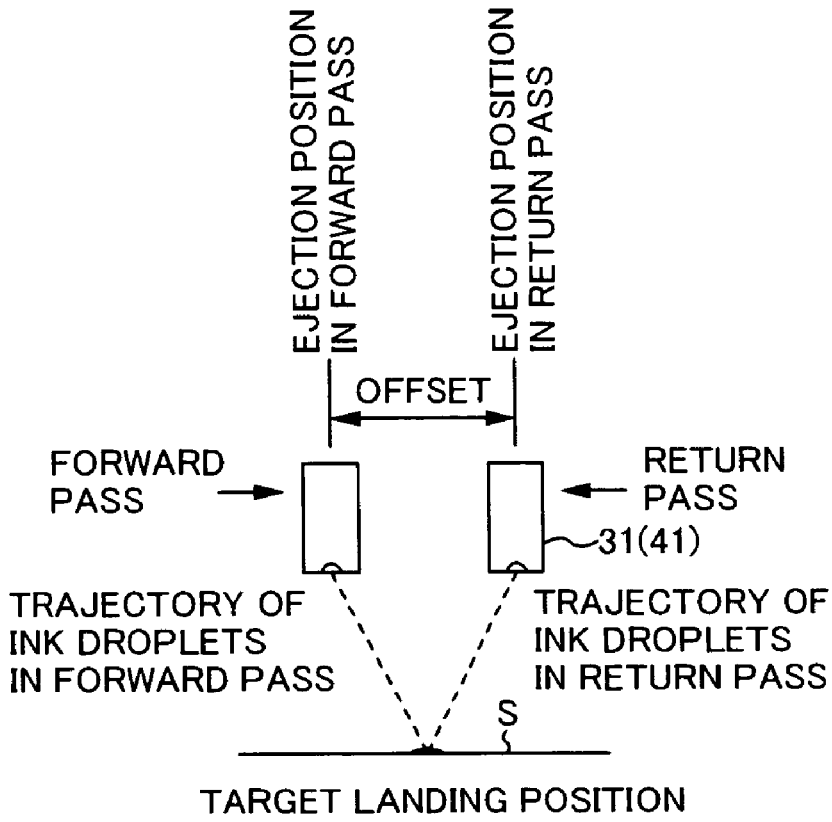

FIG. 29 is an explanatory diagram illustrating the adjustment of the ejection timing.

Figure 30A:
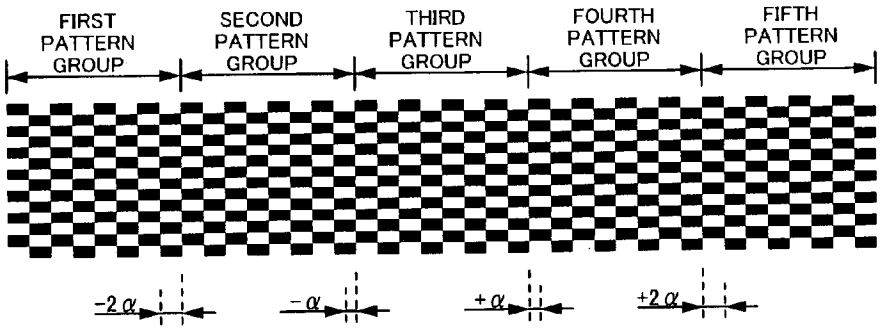
Figure 30B:
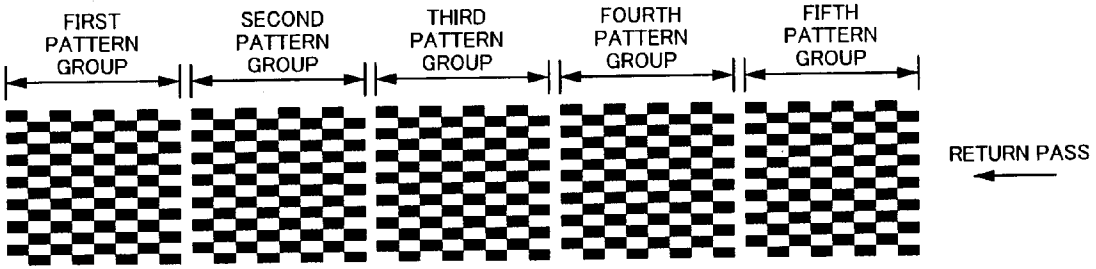
Figure 30C:
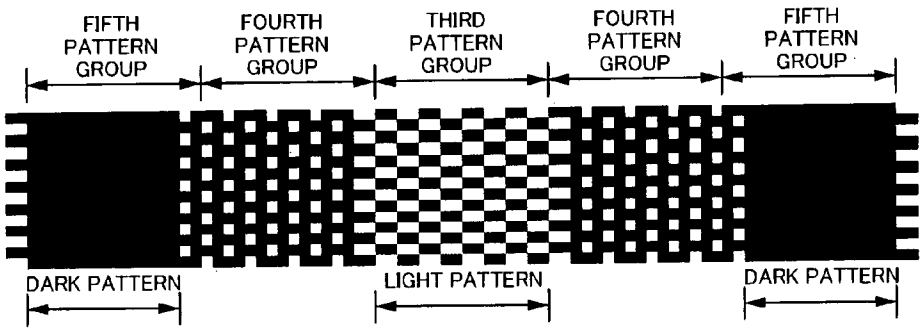

FIG. 30A is a forward pass pattern formed by ink that is ejected from nozzles during the forward pass. FIG. 30B is a return pass pattern formed by ink that is ejected from nozzles during the return pass. FIG. 30C is a correction pattern formed by overlaying the forward pass pattern and the return pass pattern.

Figure 31:
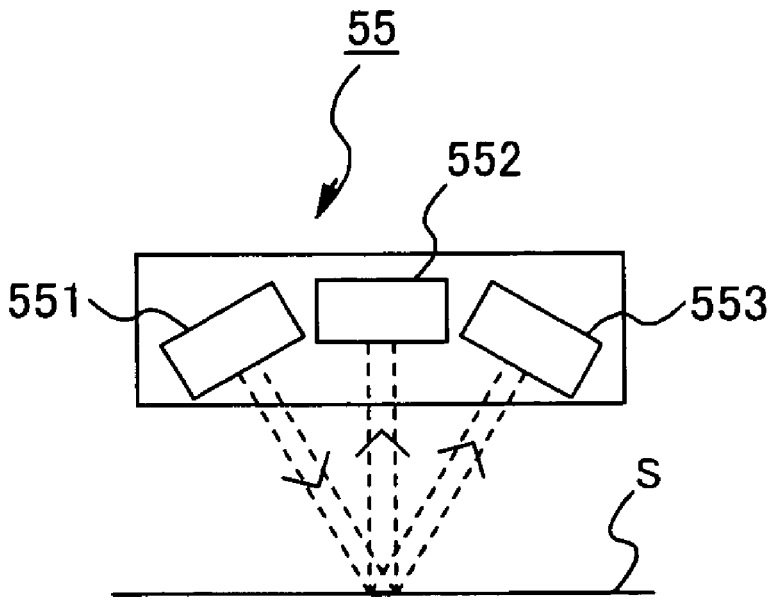

FIG. 31 is an explanatory diagram of the configuration of the downstream-side optical sensor 55 according to another embodiment.

Figure 32A:
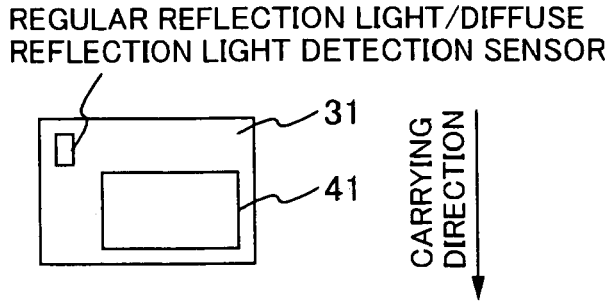
Figure 32B:
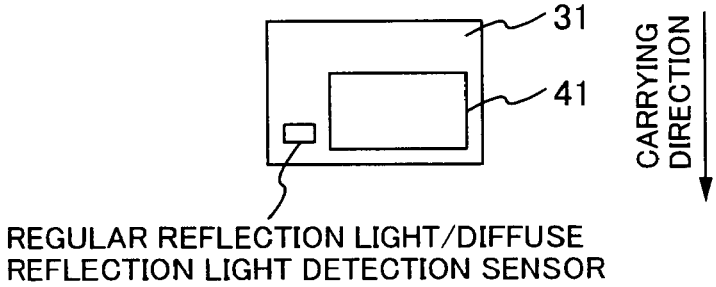
Figure 32C:
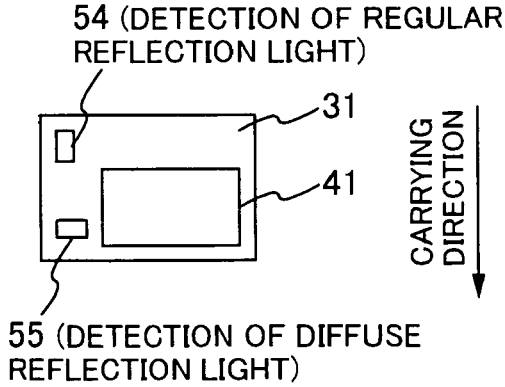

FIGS. 32A and 32B are explanatory diagrams of the configuration of comparative examples. FIG. 32C is a simplified explanatory diagram of the configuration of the sensors of the present embodiment.

REGARDING THE REFERENCE NUMERALS

1 printer,
20 carry unit, 21 paper supply roller, 22 carry motor (PF motor),
23 carry roller, 24 platen, 25 paper discharge roller,
30 carriage unit, 31 carriage,
32 carriage motor (CR motor),
40 head unit, 41 head
50 detector group, 51 linear encoder, 52 rotary encoder,
53 paper detection sensor, 54 upstream-side optical sensor, 55 downstream-side optical sensor,
60 controller, 61 interface section 62 . . . CPU,
63 memory, 64 unit control circuit,
100 printing system,
110 computer,
120 display device,
130 input device, 130A keyboard, 130B mouse,
140 recording/reproducing devices, 140A flexible disk drive device 140B CD-ROM drive device,
112 video driver, 114 application program,
116 printer driver,
L1 distance in carrying direction between the nozzle #180 and the upstream-side optical sensor 54,
L1 distance in carrying direction between the nozzle #1 and the downstream-side optical sensor 55

BEST MODE FOR CARRYING OUT THE INVENTION

Overview of the Disclosure

At least the following matters will be made clear by the explanation in the present specification and the description of the accompanying drawings.

A printing apparatus in accordance with the present invention comprises:

a movable head that performs recording on a medium using ink;

a first sensor that can move together with the head and that detects regular reflection light from the medium; and a second sensor that is provided separately from the first sensor, that can move together with the recording head and that detects diffuse reflection light from the medium.

With this printing apparatus, the number of detectable features can be increased, without the operations before and after the detection becoming slower and without a drop in the detection precision.

Another printing apparatus in accordance with the present invention comprises a carry unit that carries a medium in a carrying direction; a movable head that performs recording on a medium using ink; a first sensor that can move together with the head and that detects an edge of the medium; and a second sensor that can move together with the head and that detects a pattern formed on the medium by the head; wherein the first sensor is provided further upstream with regard to the carrying direction than the second sensor.

With this printing apparatus, two movable sensors are provided, so that the features to be detected can be split between these two sensors.

In this printing apparatus, it is preferable that the first sensor is provided further upstream with regard to a carrying direction in which the medium is carried than the second sensor. Thus, it is possible to detect the features to be detected at a suitable position, and to speed up the operations before and after the detection and to increase the precision.

In this printing apparatus, it is preferable that the first sensor includes a light-emitting section and a light-receiving section; the second sensor includes a light-emitting section and a light-receiving section; and a direction in which the light-emitting section and the light-receiving section of the first sensor are arranged is different from a direction in which the light-emitting section and the light-receiving section of the second sensor are arranged. Thus, the detection regions (detection spots) of the light-emitting section have a directionality (sensitivity improves in a predetermined direction) that depends on the direction in which the light-emitting section and the light-receiving section are arranged, so that it is possible to arrange the light-emitting section and the light-receiving section in the way suitable for the respective sensors. It is further preferable that the light-emitting section and the light-receiving section of the first sensor are arranged in a direction in which the medium is carried; and the light-emitting section and the light-receiving section of the second sensor are arranged in a direction in which the head is moved. Thus, the first sensor can detect, for example, lateral edges of the paper with high precision, and the second sensor can detect patterns formed on the paper with high precision.

In this printing apparatus, it is preferable that the first sensor is a sensor for detecting an edge of the medium. Thus, it is possible to detect edges of the paper with high precision.

In this printing apparatus, it is preferable that the second sensor is a sensor for detecting a pattern formed on the medium by the head. Thus, it is possible to detect patterns with high precision.

In this printing apparatus, it is preferable that the first sensor includes a light-emitting section and a light-receiving section; the light-emitting section of the first sensor irradiates light onto the medium; and the light-receiving section of the first sensor receives regular reflection light from the medium. Thus, the upstream-side optical sensor 54 can detect whether or not paper is present in the detection spot, and as a result, the edges of the paper can be detected.

In this printing apparatus, it is preferable that the second sensor includes a light-emitting section and a light-receiving section; the light-emitting section of the second sensor irradiates light onto the medium; and the light-receiving section of the second sensor receives diffuse reflection light from the medium. Thus, the downstream-side optical sensor 55 can detect the darkness of patterns in the detection spot.

In this printing apparatus, it is preferable that the carry unit is controlled in accordance with the detection result of the first sensor. Thus, the information for controlling the carry unit can be detected with the optimal sensor. Furthermore, the information for the carrying operation can be detected at the optimal position.

In this printing apparatus, it is preferable that the head is controlled in accordance with the detection result of the first sensor. Thus, the information for controlling the head can be detected with the optimal sensor. Furthermore, the information used for the ejection operation can be detected at the optimal position.

In this printing apparatus, it is preferable that the first sensor detects a lateral edge of the medium; and a region onto which ink is to be ejected from the head is determined in accordance with the result of detecting the lateral edge. Thus, the information for determining the region onto which ink is ejected from the head can be detected with the optimal sensor. Furthermore, the information for determining the region onto which ink is ejected from the head can be detected at the optimal position.

In this printing apparatus, it is preferable that the first sensor detects an upper edge of the medium; and the carry unit carries the medium to a print start position in accordance with the result of detecting the upper edge. Thus the information necessary for carrying the medium to the print start position can be detected with the optimal sensor. Furthermore, the information necessary for carrying the medium to the print start position can be detected at the optimal position.

In this printing apparatus, it is preferable that the first sensor detects a lower edge of the medium; and a region onto which ink is to be ejected from the head is determined in accordance with the result of detecting the lower edge. Thus, the information for determining the region onto which ink is ejected from the head can be detected with the optimal sensor. Furthermore, the information for determining the region onto which ink is ejected from the head can be detected at the optimal position.

In this printing apparatus, it is preferable that an ejection test of the head is performed in accordance with the result of detecting the pattern with the second sensor. Thus, the information used for the ejection test can be detected with the optimal sensor. Furthermore, the information used for the ejection test can be detected at the optimal position. In this printing apparatus it is also possible that a process of cleaning the head is performed in accordance with the detection result of the second sensor. Thus, clogging of the nozzles can be prevented.

In this printing apparatus, it is preferable that the head can eject the ink while moving in a forward pass and in a return pass; and locations at which ink is to be ejected from the head are determined in accordance with the detection result of the second sensor. Thus, the information for determining the ejection position can be detected with the optimal sensor. Furthermore, the information for determining the ejection position can be detected at the optimal position.

In this printing apparatus, it is preferable that the type of the medium is detected from the detection result of the first sensor and the detection result of the second sensor. Thus, one feature can be detected using two sensors. Moreover, thus, the type of the paper can be detected using two different sensors. In this printing apparatus, it is further possible that the head performs the recording on the medium in accordance with the type of the medium. Thus, printing that is suitable for the paper type is performed.

A printing system in accordance with the present invention comprising:

a computer; and a printing apparatus, the printing apparatus including:

a movable head that performs recording on a medium using ink;

a first sensor that can move together with the head and that detects regular reflection light from the medium; and a second sensor that is provided separately from the first sensor, that can move together with the recording head and that detects diffuse reflection light from the medium.

With such a printing system, it is possible to increase the number of features that can be detected, without slowing down the operations before and after the detection, and without a drop in the detection precision.

Another printing system according to the present invention comprising:

a computer; and a printing apparatus, the printing apparatus including:

a carry unit that carries a medium in a carrying direction;

a movable head that performs recording on a medium using ink;

a first sensor that can move together with the head and that detects an edge of the medium; and a second sensor that can move together with the head and that detects a pattern formed on the medium by the head;

wherein the first sensor is provided further upstream with regard to the carrying direction than the second sensor.

With such a printing system, two movable sensors are provided, so that the features to be detected can be split between these sensors.

Configuration of the Printing System

An embodiment of a printing system (computer system) is described next with reference to the drawings. However, the description of the following embodiment also encompasses implementations relating to a computer program and a recording medium storing the computer program, for example.

Figure 1:
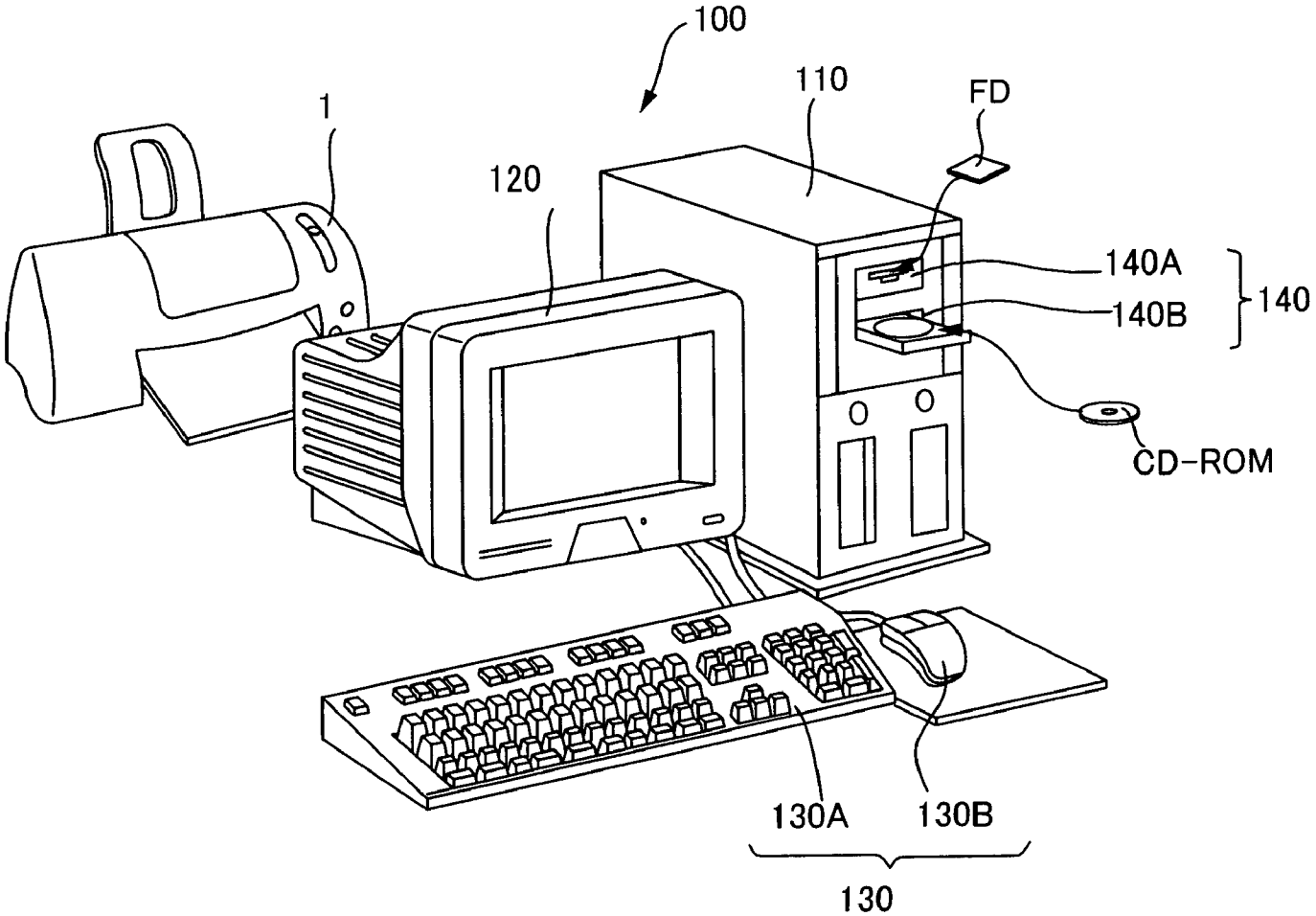
FIG. 1 is an explanatory diagram of the overall configuration of the printing system.

FIG. 1 is an explanatory diagram showing the external structure of the printing system. A printing system 100 is provided with a printer 1, a computer 110, a display device 120, input devices 130, and recording/reproducing devices 140. The printer 1 is a printing apparatus for printing images on a medium such as paper, cloth, or film. The computer 110 is electrically connected to the printer 1, and outputs print data corresponding to an image to be printed to the printer 1 in order to print the image with the printer 1. The display device 120 has a display, and displays a user interface such as an application program or a printer driver. The input devices 130 are for example a keyboard 130A and a mouse 130B, and are used to operate an application program or adjust the settings of the printer driver, for example, in accordance with the user interface that is displayed on the display device 120. A flexible disk drive device 140A and a CD-ROM drive device 140B are employed as the recording/reproducing devices 140.

A printer driver is installed on the computer 110. The printer driver is a program for achieving the function of displaying the user interface on the display device 120, and in addition it also achieves the function of converting image data that has been output from the application program into print data. The printer driver is stored on a recording medium (computer-readable recording medium) such as a flexible disk FD or a CD-ROM. But the printer driver also can be downloaded onto the computer 110 via the Internet. It should be noted that this program is made of code for achieving various functions.

It should be noted that "printing apparatus" in a narrow sense means the printer 1, but in a broader sense it means the system constituted by the printer 1 and the computer 110.

Printer Driver

<Regarding the Printer Driver>

Figure 2:
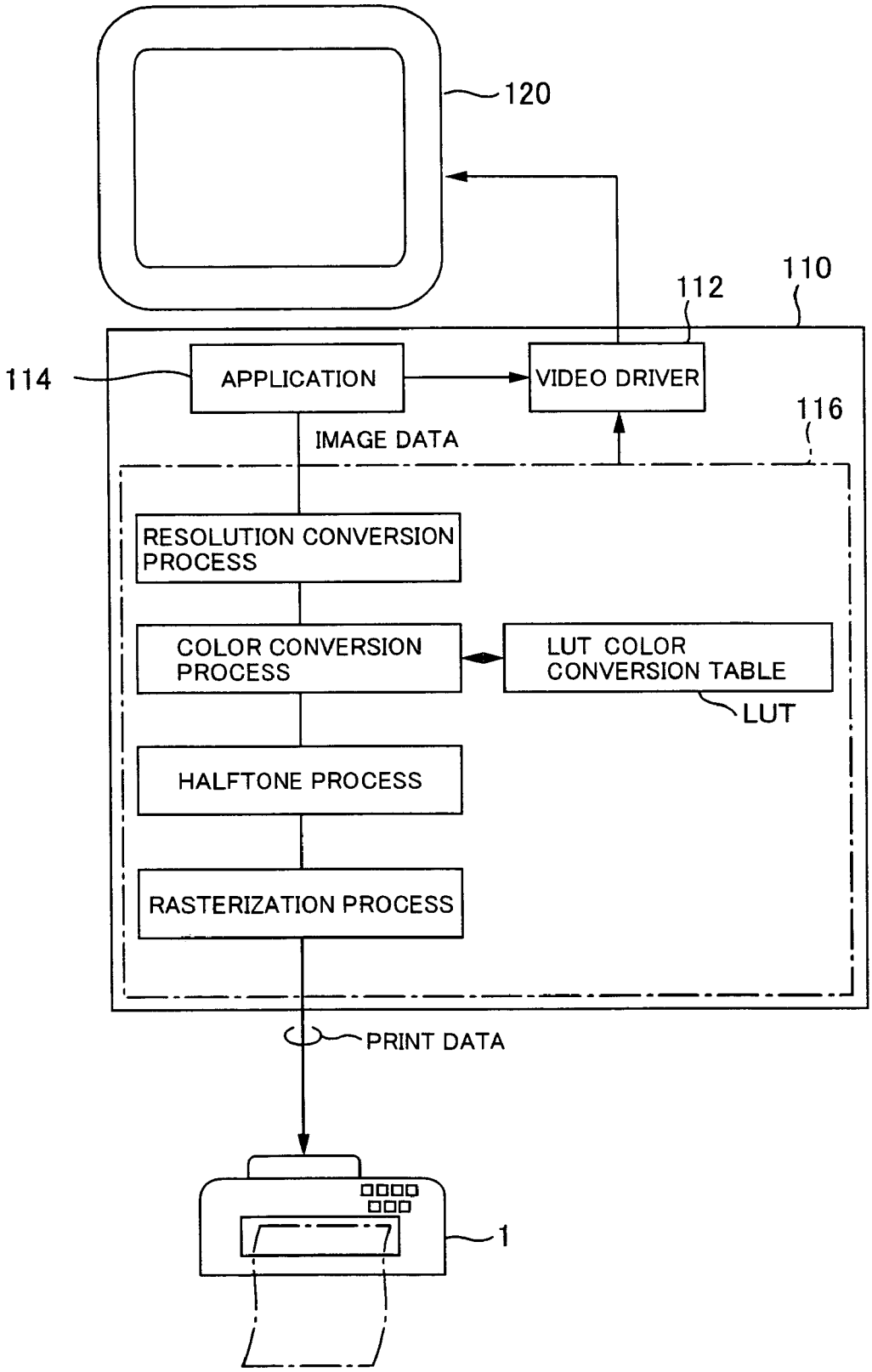
FIG. 2 is an explanatory diagram of processes carried out by a printer driver.

FIG. 2 is a schematic explanatory diagram of basic processes carried out by the printer driver. Structural elements that have already been described are assigned identical reference numerals and thus their further description is omitted.

On the computer 110, computer programs such as a video driver 112, an application program 114, and a printer driver 116 operate under an operating system installed on the computer. The video driver 112 has a function for displaying, for example, the user interface on the display device 120 in accordance with display commands from the application program 114 and the printer driver 116. The application program 114, for example, has a function for image editing or the like and creates data related to an image (image data). A user can give an instruction to print an image edited in the application program 114 via the user interface of the application program 114. Upon receiving the print instruction, the application program 114 outputs the image data to the printer driver 116.

The printer driver 116 receives the image data from the application program 114, converts the image data to print data, and outputs the print data to the printer. Here, "print data" refers to data in a format that can be interpreted by the printer 1 and that includes various command data and pixel data. Here, "command data" refers to data for instructing the printer to carry out a specific operation. Furthermore, "pixel data" refers to data related to pixels that constitute an image to be printed (print image), for example, data related to dots to be formed in positions on the paper corresponding to certain pixels (data for dot color and size, for example).

In order to convert the image data that is output from the application program 114 to print data, the printer driver 116 carries out processes such as resolution conversion processing, color conversion processing, halftone processing, and rasterization. Resolution conversion processing is a process in which image data (text data, image data, etc.) output from the application program 114 is converted to a resolution for printing on paper. Color conversion processing is a process in which RGB data is converted to CMYK data that is expressed using CMYK color space. Halftone processing is a process in which data of a high number of gradations is converted to data of a number of gradations that can be formed by the printer. Rasterization is a process in which image data in a matrix form is changed to data in an order suitable for transfer to the printer. Rasterized data is output to the printer as pixel data containing print data.

<Regarding the Settings of the Printer Driver>

Figure 3:
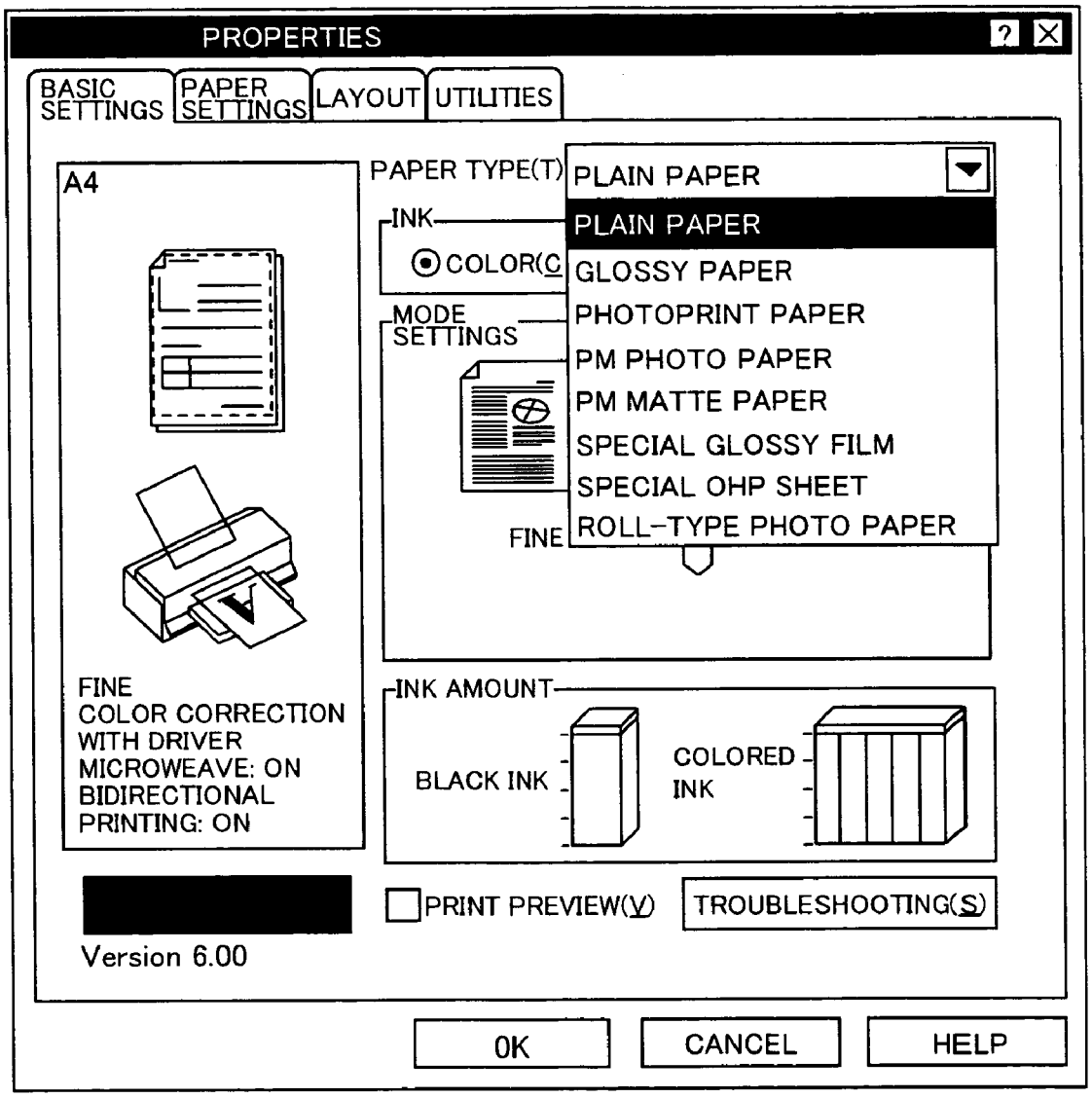
FIG. 3 is an explanatory diagram of a user interface of the printer driver.

FIG. 3 is an explanatory diagram of a user interface of the printer driver. The user interface of the printer driver is displayed on a display device via the video driver 112. The user can use the input device 130 to set the various settings of the printer driver.

The user can select the print mode from this screen. For example, the user can select as the print mode a quick print mode or a fine print mode. The printer driver then converts the image data to print data such that the data is in a format corresponding to the selected print mode.

Furthermore, from this screen, the user can select the print resolution (the dot spacing when printing). For example, the user can select from this screen 720 dpi or 360 dpi as the print resolution. The printer driver then carries out resolution conversion processing in accordance with the selected resolution and converts the image data to print data.

Furthermore, from this screen, the user can select the print paper to be used for printing. For example, the user can select plain paper or glossy paper as the print paper. Since the way ink is absorbed and the way ink dries varies if the type of paper (paper grade) varies, the amount of ink suitable for printing also varies. For this reason, the printer driver converts the image data to print data in accordance with the selected paper grade.

In this way, the printer driver converts image data to print data in accordance with conditions that are set via the user interface. It should be noted that, in addition to performing various settings of the printer driver, the user can also be notified, through this screen, of such information as the amount of ink remaining in the cartridges.

Configuration of the Printer

<Regarding the Configuration of the Inkjet Printer>

Figure 4:
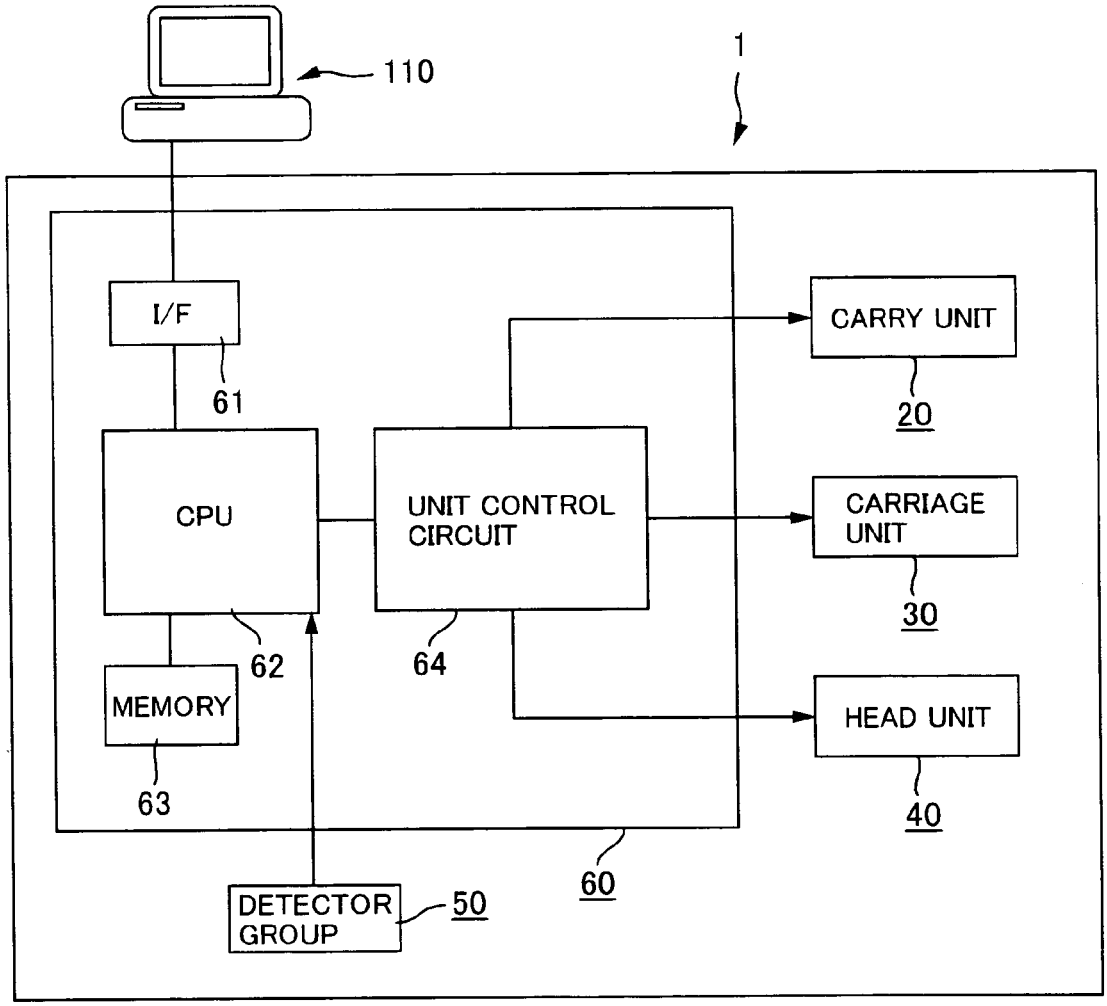
FIG. 4 is a block diagram of the overall configuration of the printer.
Figure 5:
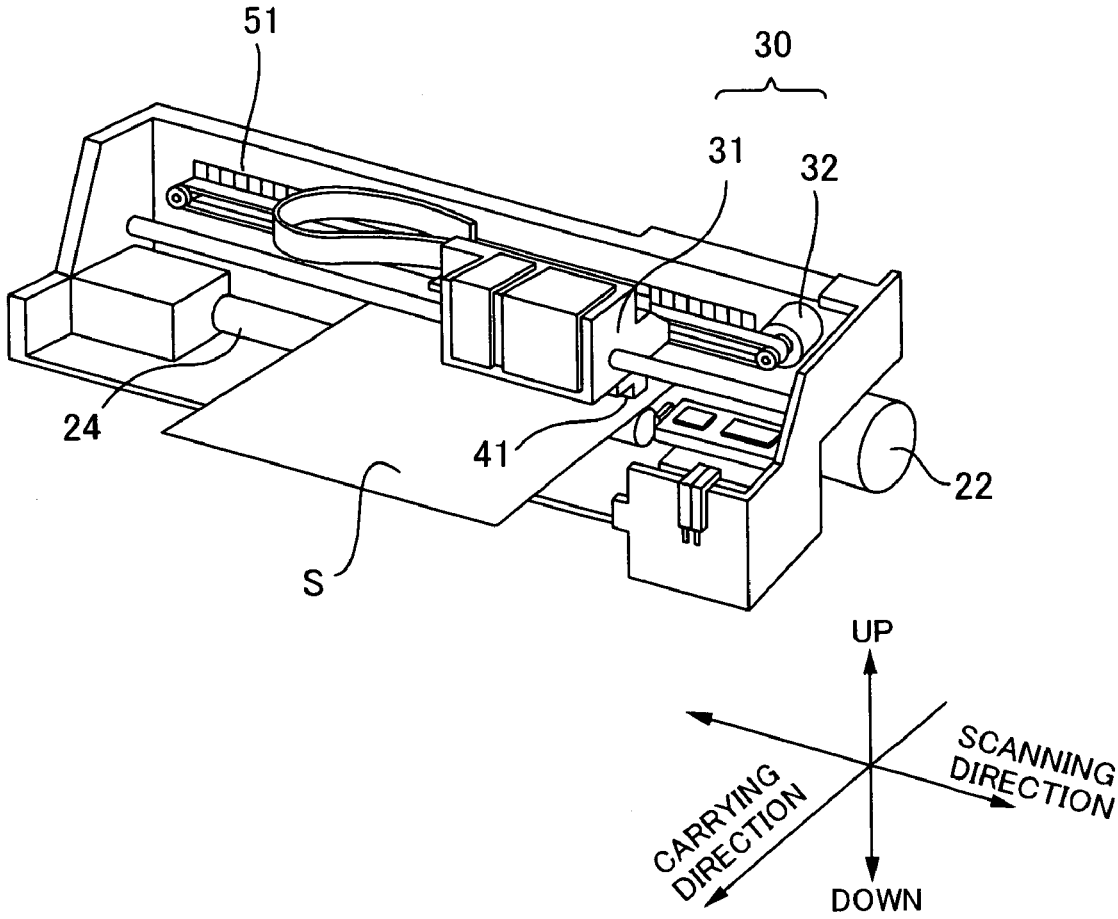
FIG. 5 is a schematic view of the overall configuration of the printer.
Figure 6:
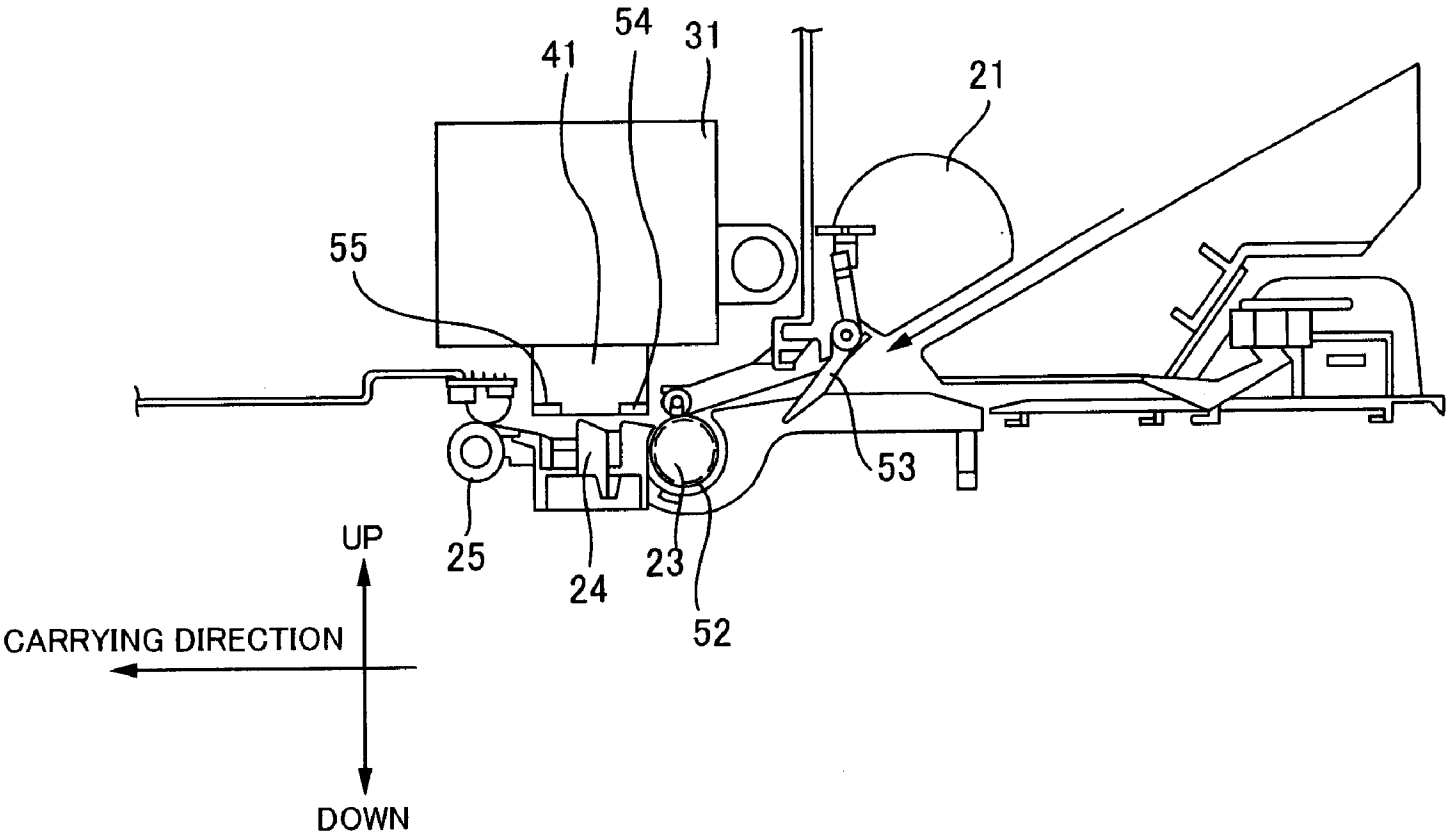
FIG. 6 is a transverse sectional view of the overall configuration of the printer.

FIG. 4 is a block diagram of the overall configuration of the printer of this embodiment. Also, FIG. 5 is a schematic diagram of the overall configuration of the printer of this embodiment. FIG. 6 is lateral sectional view of the overall configuration of the printer of this embodiment. The basic structure of the printer according to the present embodiment is described below.

The printer of this embodiment has a carry unit 20, a carriage unit 30, a head unit 40, a detector group 50, and a controller 60. The printer 1, which receives print data from the computer 110, which is an external device, controls the various units (the carry unit 20, the carriage unit 30, and the head unit 40) using the controller 60. The controller 60 controls the units in accordance with the print data that has been received from the computer 110 to form an image on a paper. The detector group 50 monitors the conditions within the printer 1, and outputs the results of this detection to the controller 60. The controller receives the detection results from the detector group 50, and controls the various units based on these detection results.

The carry unit 20 is for feeding a medium (for example, paper S) into a printable position and carrying the paper in a predetermined direction (hereinafter, referred to as the carrying direction) by a predetermined carry amount during printing. In other words, the carry unit 20 functions as a carrying mechanism (a carrying means) for carrying paper. The carry unit 20 has a paper supply roller 21, a carry motor 22 (hereinafter, referred to as PF motor), a carry roller 23, a platen 24, and a paper discharge roller 25. However, the carry unit 20 does not necessarily have to include all of these structural elements in order to function as a carrying mechanism. The paper supply roller 21 is a roller for automatically supplying paper that has been inserted into a paper insert opening into the printer. The paper supply roller 21 has a cross-sectional shape in the shape of the letter D, and the length of its circumference section is set longer than the carrying distance to the carry roller 23, so that the paper can be carried up to the carry roller 23 using this circumference section. The carry motor 22 is a motor for carrying paper in the carrying direction, and is constituted by a DC motor. The carry roller 23 is a roller for carrying the paper S that has been supplied by the paper supply roller 21 up to a printable region, and is driven by the carry motor 22. The platen 24 supports the paper S during printing. The paper discharge roller 25 is a roller for discharging the paper S on which printing has finished out of the printer. The paper discharge roller 25 is rotated in synchronization with the carry roller 23.

The carriage unit 30 is for letting the head move (scanning movement) in a predetermined direction (hereinafter, this is referred to as the "scanning direction"). The carriage unit 30 has a carriage 31 and a carriage motor 32 (also referred to as "CR motor"). The carriage 31 can be moved back and fourth in the scanning direction. (Thus, the head is moved in the scanning direction.) The carriage 31 detachably retains an ink cartridge containing ink. The carriage motor 32 is a DC motor for moving the carriage 31 in the scanning direction.

The head unit 40 is for ejecting ink onto paper. The head unit 40 has a head 41. The head 41 has a plurality of nozzles serving as ink ejection sections and ejects ink intermittently from these nozzles. The head 41 is provided on the carriage 31. Thus, when the carriage 31 moves in the scanning direction, the head 41 also moves in the scanning direction. A dot line (raster line) is formed on the paper in the scanning direction as a result of the head 41 intermittently ejecting ink while moving in the scanning direction.

The detector group 50 includes a linear encoder 51, a rotary encoder 52, a paper detection sensor 53, and an upstream-side optical sensor 54, for example. The linear encoder 51 is for detecting the position of the carriage 31 in the scanning direction. The rotary encoder 52 is for detecting the amount of rotation of the carry roller 23. The paper detection sensor 53 is for detecting the position of the front edge of the paper to be printed. The paper detection sensor 53 is provided in a position where it can detect the position of the front edge of the paper as the paper is being fed toward the carry roller 23 by the paper supply roller 21. It should be noted that the paper detection sensor 53 is a mechanical sensor that detects the front edge of the paper through a mechanical mechanism. More specifically, the paper detection sensor 53 has a lever that can be rotated in the carrying direction, and this lever is disposed such that it protrudes into the path over which the paper is carried. For this reason, the front edge of the paper comes into contact with the lever and the lever is rotated, and thus the paper detection sensor 53 detects the position of the front edge of the paper by detecting the movement of the lever. The upstream-side optical sensor 54 is attached to the carriage 31. The upstream-side optical sensor 54 detects whether or not the paper is present by its light-receiving section detecting reflected light of the light that has been irradiated onto the paper from the light-emitting section. The upstream-side optical sensor 54 detects the position of the edge of the paper while being moved by the carriage 41. The upstream-side optical sensor 54 optically detects the edge of the paper, and thus has higher detection accuracy than the mechanical paper detection sensor 53.

In the present embodiment, the detector group 50 also includes a downstream-side optical sensor 55. The downstream-side optical sensor 55 is attached to the carriage 31. The downstream-side optical sensor 55 detects the pattern formed on the paper, as a result of its light-receiving section detecting reflected light of the light that has been irradiated onto the paper from the light-emitting section. The configuration of the downstream-side optical sensor 55 is explained in more detail later.

The controller 60 is a control unit (controlling means) for carrying out control of the printer. The controller 60 has an interface section 61, a CPU 62, a memory 63, and a unit control circuit 64. The interface section 61 is for exchanging data between the computer 110, which is an external device, and the printer 1. The CPU 62 is a computer processing device for carrying out overall control of the printer. The memory 63 is for ensuring a working region and a region for storing the programs for the CPU 62, for instance, and includes storage means such as a RAM or an EEPROM. The CPU 62 controls the various units via the unit control circuit 64 in accordance with programs stored in the memory 63.

<Regarding the Printing Operation>

Figure 7:
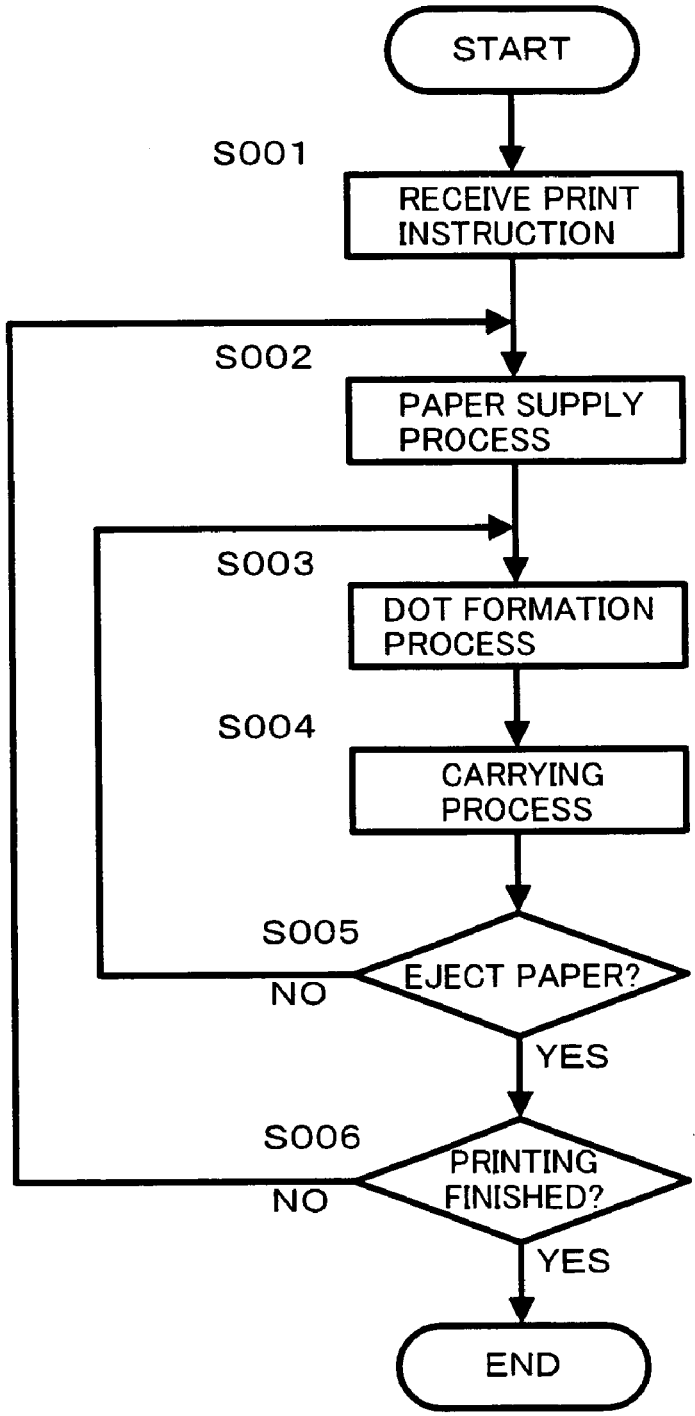
FIG. 7 is a flowchart of the processing during printing.

FIG. 7 is a flowchart of the processing during printing. The processes described below are executed by the controller 60 controlling the various units in accordance with a program stored in the memory 63. This program includes code for executing the various processes.

The controller 60 receives a print command via the interface section 61 from the computer 110 (S001). This print command is included in the header of the print data transmitted from the computer 110. The controller 60 then analyzes the content of the various commands included in the print data that is received and uses the various units to perform the following paper supply process, carrying process, and ink ejection process, for example.

First, the controller 60 performs the paper supply process (S002). The paper supply process is a process for supplying paper to be printed into the printer and positioning the paper at a print start position (also referred to as the "indexing position"). The controller 60 rotates the paper supply roller 21 to feed the paper to be printed up to the carry roller 23. The controller 60 rotates the carry roller 23 to position the paper that has been fed from the paper supply roller 21 at the print start position. When the paper has been positioned at the print start position, at least some of the nozzles of the head 41 are in opposition to the paper.

Next, the controller 60 performs the dot formation process (S003). The dot formation process is a process for intermittently ejecting ink from a head that moves in the scanning direction so as to form dots on the paper. The controller 60 drives the carriage motor 32 to move the carriage 31 in the scanning direction. The controller 60 then causes the head to eject ink in accordance with the print data while the carriage 31 is moving. Dots are formed on the paper when ink droplets ejected from the head land on the paper.

Next, the controller 60 performs the carrying process (S004). The carrying process is a process for moving the paper relative to the head in the carrying direction. The controller 60 drives the carry motor to rotate the carry roller and thereby carry the paper in the carrying direction. Through this carrying process, the head 41 can form dots at positions that are different than the positions of the dots formed in the preceding dot formation process.

Next, the controller 60 determines whether or not to discharge the paper under printing (S005). The paper is not discharged if there is still data to be printed on the paper being printed. Then, the controller 60 alternately repeats the dot formation and carrying processes until there is no more data to be printed, thus gradually printing an image made of dots on the paper. When there is no more data to be printed on the paper being printed, the controller 60 discharges that paper. The controller 60 discharges the printed paper to the outside by rotating the paper discharge roller. It should be noted that whether or not to discharge the paper can also be determined based on a paper discharge command included in the print data.

Next, the controller 60 determines whether or not to continue printing (S006). If the next sheet of paper is to be printed, then printing is continued and the paper supply process for the next sheet of paper is started. If no further sheet of paper is to be printed, then the printing operation is ended.

<Regarding the Nozzles>

Figure 8:
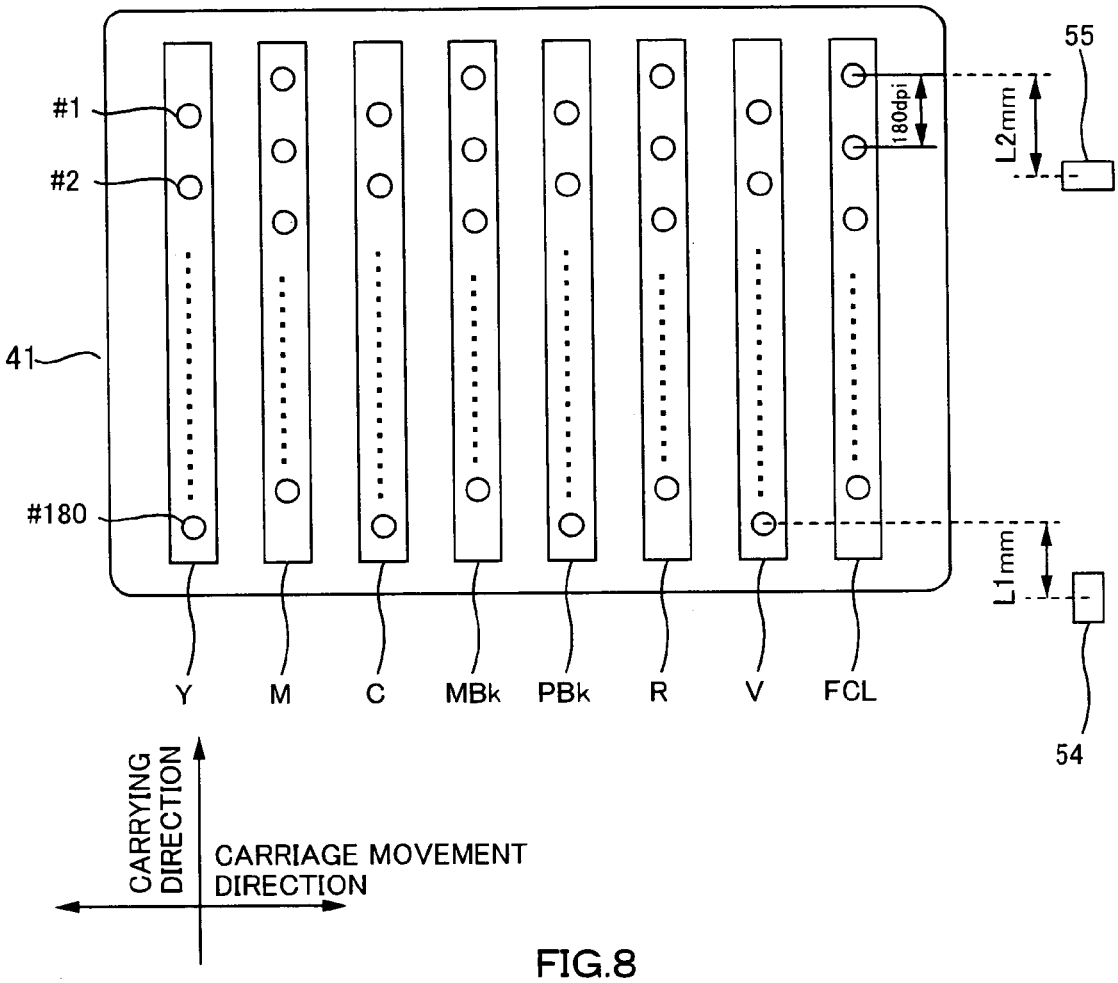
FIG. 8 is an explanatory diagram showing the arrangement of the nozzles.

FIG. 8 is an explanatory diagram of the configuration of the lower side of the carriage. The lower side of the carriage is provided with the head 41, the upstream-side optical sensor 54 and the downstream-side optical sensor 55.

A yellow ink nozzle group Y, a magenta ink nozzle group M, a cyan ink nozzle group C, a matte black ink nozzle group MBk, a photo black ink nozzle group PBk, a red ink nozzle group R, a violet ink nozzle group V, and a clear ink nozzle group FCL are formed in the lower surface of the head 41. Each nozzle group is provided with a plurality of nozzles (in this embodiment, 180), which are ejection openings for ejecting the various inks.

The plurality of nozzles of the nozzle groups are arranged in rows at a constant spacing (nozzle pitch: k·D) in the carrying direction. Here D is the minimum dot pitch in the carrying direction (that is, the spacing at the maximum resolution of dots formed on the paper S). Also, k is an integer of 1 or more. For example, if the nozzle pitch is 180 dpi (1/180 inch), and the dot pitch in the carrying direction is 720 dpi (1/720), then k=4.

Each of the nozzles of the nozzle groups is assigned a number (#1 to #180) that becomes smaller the more downstream the nozzle is arranged. That is, the nozzle #1 is positioned more downstream in the carrying direction than the nozzle #180. Each nozzle is provided with a piezo element (not shown) as a drive element for driving the nozzle and letting it eject ink droplets.

The upstream-side optical sensor 54 is arranged by a distance of L1 (mm) further upstream with respect to the carrying direction than the nozzles #180 disposed furthest on the upstream side. The downstream-side optical sensor 55 is arranged by a distance of L2 (mm) further upstream than the nozzles #1 disposed furthest on the downstream side in the carrying direction.

<Regarding the Colored Inks and the Clear Inks>

"Colored ink" here refers to colored, non-transparent inks such as yellow (Y), magenta (M), cyan (C), black (K) (here, "black" is the general term for matte black (MBk) and photo black (PBk)), red (R), or violet (V). These colored inks are made of dye inks or pigment inks, for example.

In contrast to colored inks, "clear ink" generally refers to colorless, transparent inks. Here, there is no particular limitation to colorless, transparent inks, and "clear ink" refers broadly to inks including colored transparent inks or colored nontransparent inks that are difficult to detect by diffuse reflection light when they have been ejected onto a medium. That is to say, colored nontransparent inks, such as the aforementioned yellow (Y), magenta (M), cyan (C) and black (Bk) inks that adhere to a medium can be detected with an optical sensor using diffuse reflection light, whereas clear inks that adhere to a medium are very difficult to specify whether or not it is adhered using diffuse reflection light. When such clear ink adheres to glossy paper, it has the effect of increasing the glossiness of the portion where it adheres to. When adhering to plain paper, however, clear ink hardly increases the glossiness of the portion where it adheres to.

Configuration of Optical Sensor

<Regarding the Upstream-Side Optical Sensor>

Figure 9:
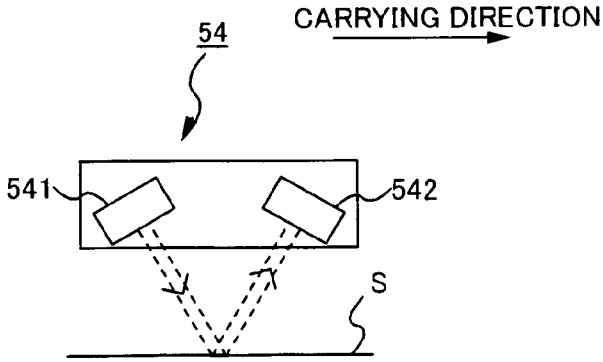
FIG. 9 is an explanatory diagram of the configuration of the upstream-side optical sensor.

FIG. 9 is an explanatory diagram of the configuration of the upstream-side optical sensor 54. The direction to the right in this figure corresponds to the carrying direction, and the direction perpendicular to the paper plane corresponds to the scanning direction.

The upstream-side optical sensor 54 is a reflective optical sensor including a light-emitting section 541 and a light-receiving section 542. The light-emitting section 541 has, for example, an infrared LED (light-emitting diode) and irradiates light onto the paper. The light-receiving section 542 has, for example, a phototransistor, and detects the reflection light of the light irradiated from the light-emitting section onto the paper.

The light-emitting section 541 of the upstream-side optical sensor 54 irradiates light obliquely onto the paper S. Also, the light-receiving section 542 of the upstream-side optical sensor 54 is arranged at a symmetrical position to the light-emitting section 541, and receives the light that is irradiated obliquely from the paper. Therefore, the light-receiving section 542 receives the regular reflection light of the light irradiated by the light-emitting section 541 onto the paper.

Figure 10:
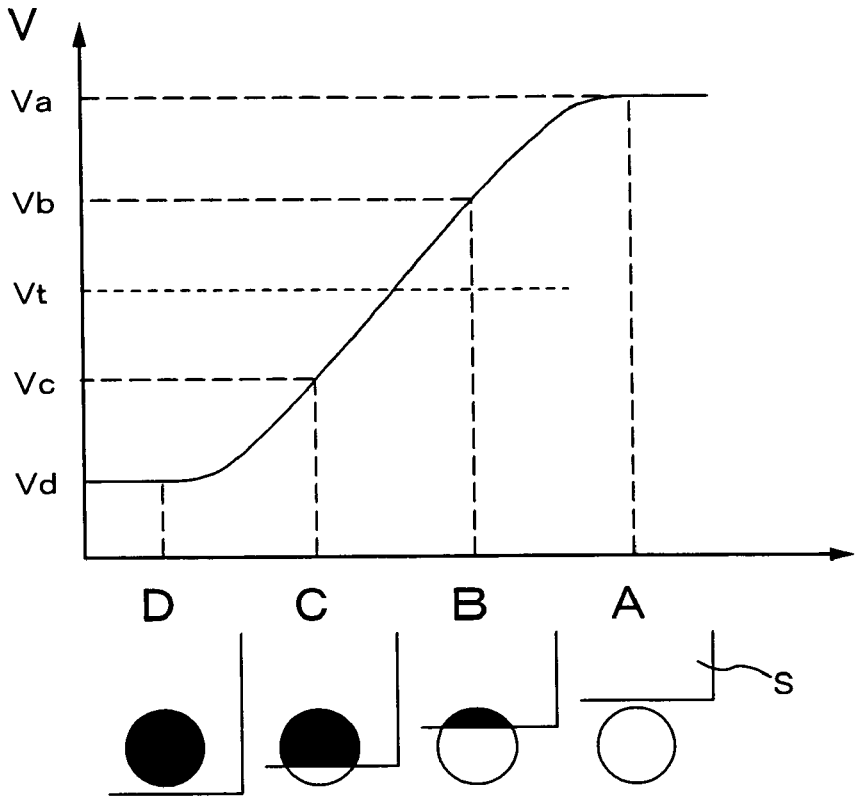
FIG. 10 is an explanatory diagram of the output signal of the upstream-side optical sensor 54.

FIG. 10 is an explanatory diagram of the output signal of the upstream-side optical sensor 54. The graph in the upper half of FIG. 10 illustrates the relationship between the position of the edge of the paper S and the signal output by the upstream-side optical sensor 54. The diagram in the lower half of FIG. 10 illustrates the relation between the position of the edge of the paper S and the detection spot of the upstream-side optical sensor. In FIG. 10, the circle indicates the detection spot of the upstream-side optical sensor. More specifically, the detection spot is the region onto which the light of the light-emitting section of the upstream-side optical sensor 54 is irradiated. The black region inside the circle indicates the area onto which the light from the light-emitting section of the upstream-side optical sensor 54 is irradiated onto the paper S. The white region inside the circle indicates the area onto which the light from the light-emitting section of the upstream-side optical sensor 54 is irradiated onto the platen.

In State A (state in which the edge of the paper S is outside the detection spot of the upstream-side optical sensor and the paper S is not in the detection spot), the light from the light-emitting section of the upstream-side optical sensor 54 is not irradiated onto the paper S. Therefore, the light-receiving section of the upstream-side optical sensor 54 cannot detect any reflected light. In this situation, the output voltage of the upstream-side optical sensor is Va. In State B (state in which the edge of the paper S is inside the detection spot of the upstream-side optical sensor and the paper S coincides partially with the detection spot), a portion of the light from the light-emitting section of the upstream-side optical sensor 54 is irradiated onto the paper S. In this situation, the output voltage of the upstream-side optical sensor 54 is Vb. In State C (state in which the edge of the paper S is inside the detection spot of the upstream-side optical sensor and the paper S coincides almost completely with the detection spot), almost all of the light from the light-emitting section of the upstream-side optical sensor 54 is irradiated onto the paper S. In this situation, the output voltage of the upstream-side optical sensor 54 is Vc. In State D (state in which the edge of the paper S is outside the detection spot of the upstream-side optical sensor and the detection spot coincides completely with the paper S), all of the light from the light-emitting section of the upstream-side optical sensor 54 is irradiated onto the paper S. In this situation, the output voltage of the upstream-side optical sensor is Vd. As can be seen from FIG. 10, the larger the region occupied by the paper S in the detection spot (the circle in the figure) of the upstream-side optical sensor 54, the larger is the light amount that is received by the light-receiving section 542, and the smaller is the output signal of the upstream-side optical sensor 54.

If the output voltage Vt is taken as a threshold, then the controller can determine State A and State B as "paperless states." If the controller determines a "paperless state," then the printer performs all operations under the assumption that there is no paper at the position of the upstream-side optical sensor. Further, if the output voltage Vt is taken as a threshold, then the controller can determine State C and State C as "paper-present states." If the controller determines a "paper-present state," then the printer performs all operations under the assumption that there is paper at the position of the upstream-side optical sensor. The output voltage Vt in the figure is equal to the output voltage of the upstream-side optical sensor 54 for the case that the paper S occupies half of the detection spot.

It should be noted that the upstream-side optical sensor 54 is a sensor for detecting whether paper is present or not. On the other hand, the controller 60 determines the presence of paper based on the output of the upstream-side optical sensor 54, so that the controller 60 and the upstream-side optical sensor 54 can be thought of as constituting a "determination section for determining the presence of paper".

<Regarding the Downstream-Side Optical Sensor>

Figure 11:
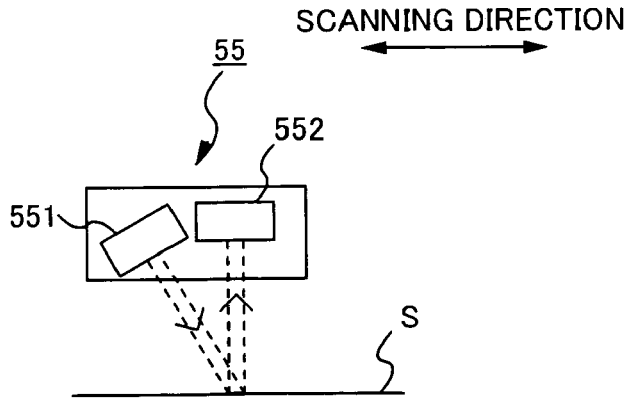
FIG. 11 is an explanatory diagram of the configuration of the downstream-side optical sensor.

FIG. 11 is an explanatory diagram of the configuration of the downstream-side optical sensor 55. The horizontal direction in this figure corresponds to the scanning direction, and the direction perpendicular to the paper plane in the figure corresponds to the carrying direction.

This downstream-side optical sensor 55 is a sensor for detecting patterns formed on paper. The detection of patterns with the downstream-side optical sensor 55 is described later.

The downstream-side optical sensor 55 is a reflective optical sensor including a light-emitting section 551 and a light-receiving section 552. The light-emitting section 551 has, for example, a white LED (light-emitting diode) and irradiates light onto the paper. The light-receiving section 552 has, for example, a phototransistor, and detects the reflection light of the light irradiated from the light-emitting section onto the paper.

The light-emitting section 551 of the downstream-side optical sensor 55 irradiates light obliquely onto the paper S. The light-receiving section 552 of the downstream-side optical sensor 55 is provided at a position perpendicular to the paper S. Therefore, the light-receiving section 552 receives the diffuse reflection light of the light irradiated by the light-emitting section onto the paper.

If there is a pattern with high darkness at the position of the detection spot of the downstream-side optical sensor 55 (at the region on the paper that is irradiated with light from the light-emitting section 551), then the amount of light received by the light-receiving section 552 decreases. On the other hand, if there is a pattern with low darkness at the position of the detection spot of the downstream-side optical sensor 55 (this includes the case that no pattern is formed at all), then the amount of light received by the light-receiving section 552 increases. That is to say, the amount of light received by the light-receiving section 552 differs depending on the darkness of the pattern, so that the controller can detect the darkness of the pattern inside the detection spot (or whether there is a pattern or not) from the signal that is output from the light-receiving section 552. It should be noted that the light-emitting section 551 of the downstream-side optical sensor irradiates light with a white LED onto the paper, so that it is possible to detect patterns of different colors.

The following is a more detailed explanation of the applications of the upstream-side optical sensor 54 and the downstream-side optical sensor 55. As will become clear from the following explanations, the upstream-side optical sensor 54 is primarily used to detect the edge (lateral edge or vertical edge) of the paper. On the other hand, the downstream-side optical sensor 55 is primarily used to detect patterns formed by the nozzle.

Method for Detecting Lateral Edge of the Paper

As explained below, the upstream-side optical sensor 54 can detect the lateral edges of the paper S. And, as also explained below, the controller controls the ejection of ink from the nozzles based on the detection results of the upstream-side optical sensor 54.

<Regarding the Necessity to Detect the Lateral Edges of the Paper>

In so-called "borderless printing," the entire surface of the paper is printed on. With such "borderless printing," printing can be carried out by ejecting ink without margins onto all four edges of the paper as well, so that an output result of an image similar to that of a photograph is obtained. This is why inkjet printers capable of "borderless printing" have gained so much popularity in recent years.

Figure 12A:
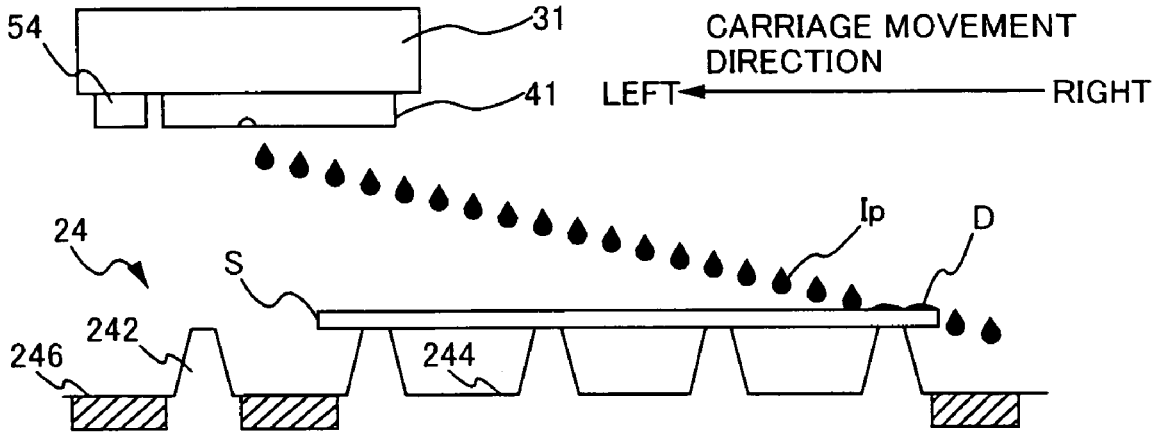
FIG. 12A is an explanatory diagram illustrating the ejection of ink during borderless printing.
Figure 12B:
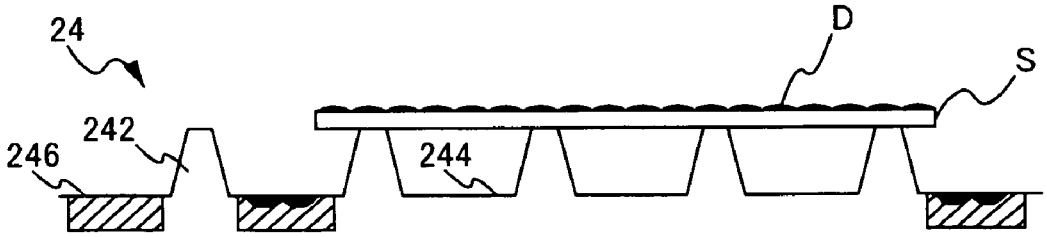
FIG. 12B is an explanatory diagram illustrating the landing positions of ink during borderless printing.

FIG. 12A is an explanatory diagram illustrating the ejection of ink during borderless printing. FIG. 12B is an explanatory diagram illustrating the landing positions of ink during borderless printing. Structural elements that have already been described are assigned identical reference numerals and thus their further description is omitted.

Ink droplets Ip are ejected from the nozzles of the head 41, and the ejected ink droplets Ip land on the paper S, forming dots D constituting the image to be printed on the paper S. In the case of borderless printing, the print data corresponds to a region that is larger than the size of the paper. That is to say, in the case of borderless printing, the region onto which ink is ejected is larger than the size of the paper. Therefore, if ink is ejected from the nozzles in accordance with the print data, then a portion of the ejected ink will not land on the paper S, but will land on the platen 14. This is not desirable, because the paper is soiled when the ink that has landed on the platen 14 adheres to the back side of the paper. Accordingly, in order to prevent soiling of the back side of the paper, the platen 24 of the printer performing borderless printing includes a protrusion 242 (also referred to as projection or rib), grooves 244 (also referred to as depressions), and absorbing material 246.

However, if the amount of ink that does not land on the paper is large, then the amount of ink consumed becomes large, which is not desirable. Therefore, a portion of the print data is replaced with NULL data, so that the region onto which ink is ejected is made smaller, thus preventing the waste of ink (it should be noted that if the print data is NULL data, then no ink is ejected from the head). The region onto which ink is ejected is determined by the controller in accordance with the output of the upstream-side optical sensor 54 (that is, the region of the print data that is replaced by NULL data is determined by the controller in accordance with the output of the upstream-side optical sensor.

<Regarding Lateral Edge Processing>

Figure 13A:
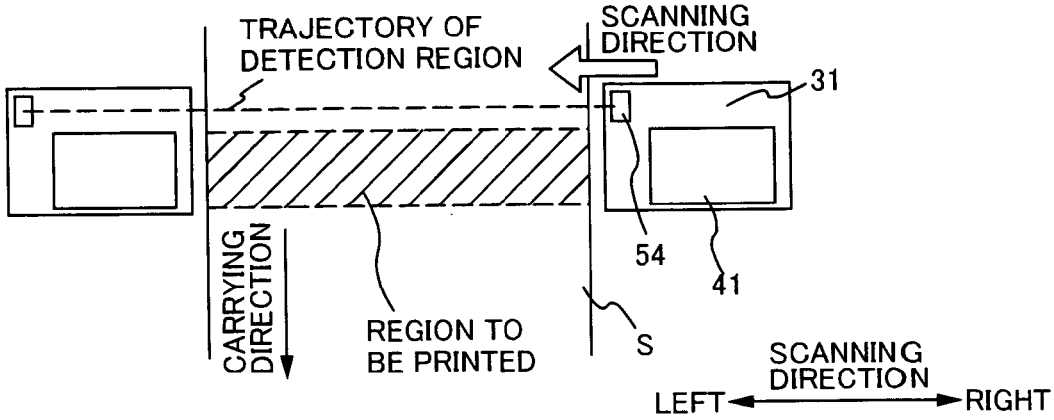
FIG. 13A is an explanatory diagram of the detection of the lateral edges of a paper.

FIG. 13A is an explanatory diagram of the detection of the lateral edges of a paper. In this figure, structural elements that have already been explained are assigned identical reference numerals and therefore are not further explained. The hatched portion in the figure indicates the region in which dots are formed on the paper (printed region). While the carriage 31 moves in the scanning direction, the head 41 intermittently ejects ink, forming dots on the hatched region in the figure, so that a stripe-shaped image fragment is printed on the paper. During the dot formation process, the carriage moves back and forth in the scanning direction, so that also the upstream-side optical sensor 54 moves back and forth in the scanning direction, and the upstream-side optical sensor 54 can detect the position of the two lateral edges of the paper.

Figure 13B:
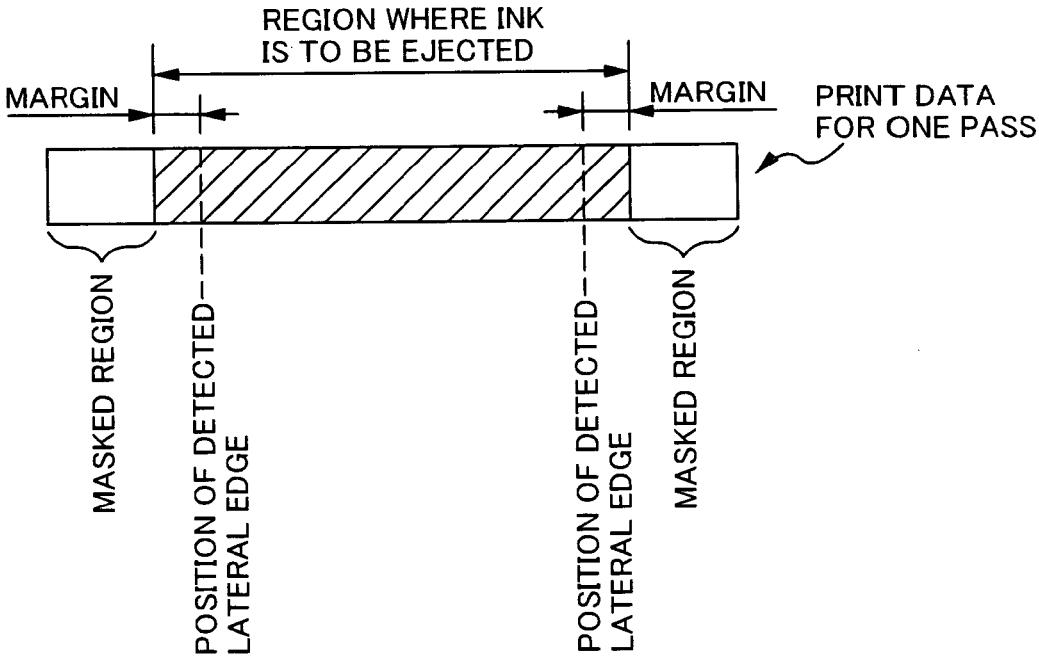
FIG. 13B is an explanatory diagram illustrating the lateral edge processing for borderless printing.

FIG. 13B is an explanatory diagram illustrating the lateral edge processing for borderless printing. It should be noted that "lateral edge processing" means the replacement of a portion of the print data with NULL data, in coordination with the width of the paper. The stripe-shaped rectangle in the figure represents the print data for one pass. Note that "one pass" means the operation of moving the carriage 31 once in the scanning direction. That is to say, the stripe-shaped rectangle in the figure represents the data that is necessary to eject ink during one pass with the nozzle #1 to nozzle #180. The print data of the hatched portion in the figure indicates the print data that is used when ejecting the ink from the head 41. On the other hand, the print data without hatching in the figure is replaced with NULL data, and indicates the print data where no ink is ejected from the head 41.

One might think that if ink would be ejected using only the print data corresponding to the inside of the detected paper, then the entire surface of the paper should be printed on and perfect borderless printing should be accomplished. However, when the paper is carried obliquely, margins result at the lateral edges of the paper, and it is not possible to perform flawless borderless printing. Therefore, the print data is replaced with NULL data while affording a predetermined margin in anticipation of the portion that the paper is carried obliquely, and the region onto which ink is ejected is made somewhat wider than the lateral edges of the paper.

In the lateral edge process, the upstream-side optical sensor 54 detects both lateral edges of the paper, and the region onto which ink is ejected (for example the hatched region in FIG. 13B) is determined in accordance with the detection result.

Detection of the Upper Edge of the Paper

As explained below, the upstream-side optical sensor 54 can detect the upper edge of the paper S. And, as also explained below, the controller carries the paper S based on the detection results of the upstream-side optical sensor 54.

Figure 14A:
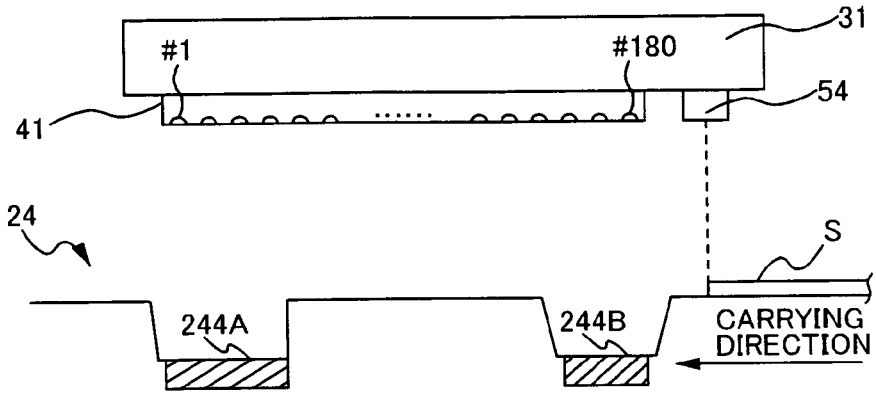
FIG. 14A is an explanatory diagram illustrating the detection of the upper edge of the paper with the upstream-side optical sensor 54.

FIG. 14A is an explanatory diagram illustrating the detection of the upper edge of the paper with the upstream-side optical sensor 54. The direction perpendicular to the paper plane of FIG. 14A is the scanning direction in which the carriage 31 moves. The horizontal direction in FIG. 14A is the carrying direction in which the paper S is carried. Numeral 244A denotes a downstream-side groove provided in the platen 24. The downstream-side groove 244A is provided in opposition to a plurality of nozzles on the downstream side (nozzle #1 etc.). If the paper S is not present, the ink ejected from the plurality of nozzles in opposition to the downstream-side grooves 244A lands in the downstream-side groove 244A. Numeral 244B denotes an upstream-side groove provided in the platen. Further explanations of structural elements in the figure that have been described already have been omitted.

While the paper S is carried in the carrying direction by the carry roller, the upper edge of the paper S traverses the detection spot (explained before) of the upstream-side optical sensor 54. When the upper edge of the paper S traverses the detection spot of the upstream-side optical sensor 54, the output signal of the upstream-side optical sensor changes (see FIG. 10). Therefore, when the paper S is carried, if the output signal of the upstream-side optical sensor 54 reaches the threshold Vt, the controller can detect that the upper edge of the paper S has reached the position of the detection spot of the upstream-side optical sensor 54.

Figure 14B:
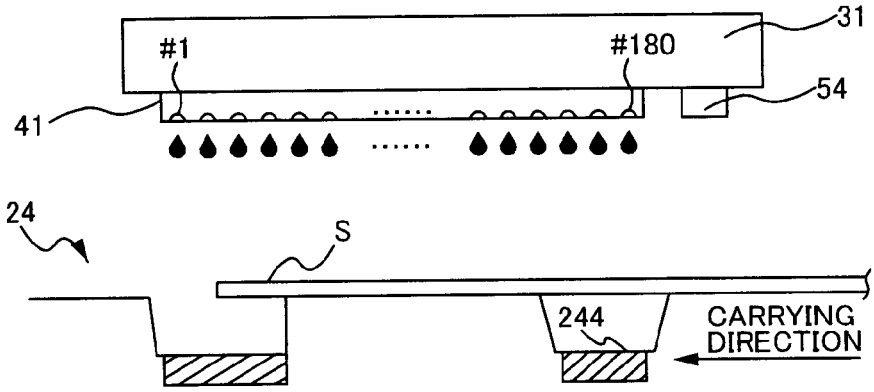
FIG. 14B is an explanatory diagram illustrating the situation when the paper S has been carried based on the detection result of the upstream-side optical sensor 54.

FIG. 14B is an explanatory diagram illustrating the situation when the paper S has been carried based on the detection result of the upstream-side optical sensor 54. As shown in the figure, based on the detection result of the upstream-side optical sensor 54, the controller positions the upper edge of the paper S between the downstream-side groove 244A and the nozzles in opposition to the downstream-side groove 244A using the carry unit. Thus, even when ink is ejected from all nozzles, the platen 24 will not be soiled by ink, so that the rear side of the paper can be prevented from becoming soiled.

Figure 14C:
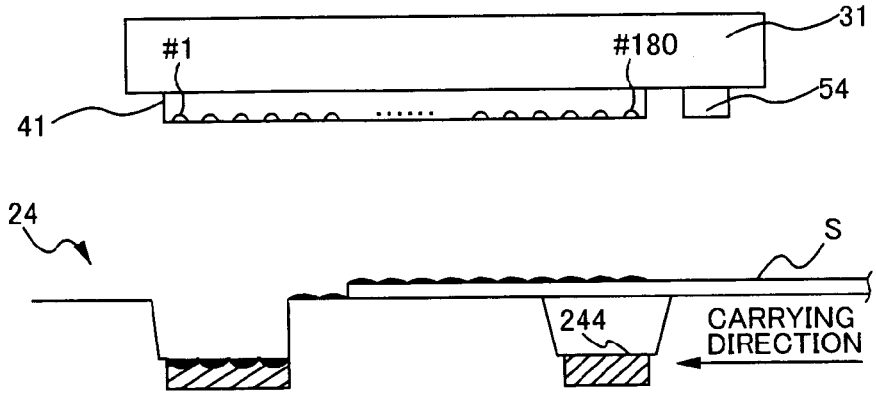
FIG. 14C is a comparative example.

FIG. 14C is a comparative example. If the paper S were positioned without using the detection result of the upstream-side optical sensor 54, then it would not be possible to position the upper edge of the paper S accurately between the downstream-side groove 244A and the nozzles in opposition to the downstream-side groove 244A. As a result, when ink is ejected from all nozzles, the platen 24 is soiled by the ink, and the rear side of the paper will be soiled. In this case, in order to print the upper edge of the paper S such that the platen 24 is not soiled, ink must be ejected only from the nozzles in opposition to the downstream-side groove 244A. However, this reduces the number of nozzles from which ink is ejected, so that the printing time becomes long.

Thus, the upper edge of the paper S can be printed faster by letting the controller position the paper S (upper edge process) as suitable in accordance with the detection result of the upstream-side optical sensor 54.

Detection of the Lower Edge of the Paper

As explained below, the upstream-side optical sensor 54 can detect the lower edge of the paper S. And, as also explained below, the controller controls the ejection of ink from the nozzles based on the detection results of the upstream-side optical sensor 54.

Figure 15A:
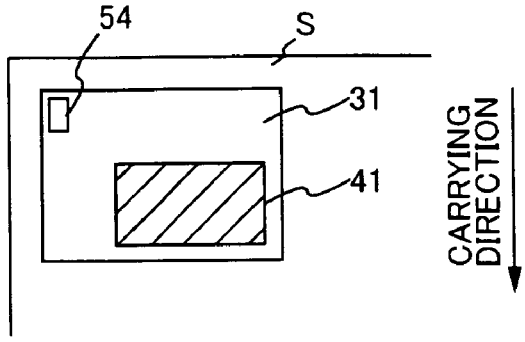
FIGS. 15A to 15C are explanatory diagrams of the lower edge process according to the present embodiment.
Figure 15B:
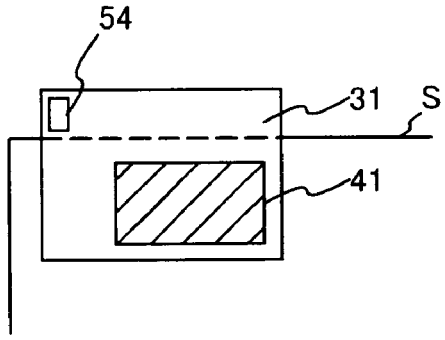
Figure 15C:
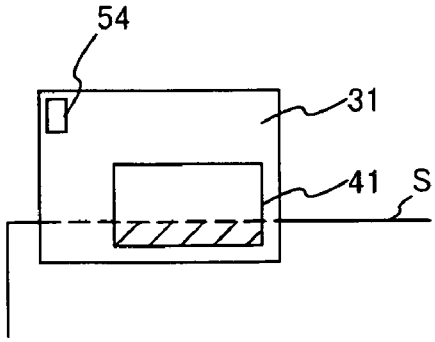

FIGS. 15A to 15C are explanatory diagrams of the lower edge process according to the present embodiment. Structural elements that have already been described are assigned identical reference numerals and thus their further description is omitted. In FIG. 15, the nozzles within the region of the hatched portion of the head 41 eject ink.

As shown in FIG. 15A, during an ordinary dot formation process, if the optical sensor 54 detects a "paper-present state," then all nozzles of the head 41 are in opposition to the paper, so that ink is ejected from all nozzles. Then, after the dot formation process, a carry process by a predetermined carry amount is performed.

As shown in FIG. 15B, when the result of the carry process is that the lower edge of the paper passes the optical sensor 54, then the optical sensor 54 detects a "paperless state." It should be noted that in the present embodiment, the optical sensor 54 is apart from the nozzle #180 by a distance corresponding to one carry amount and is located on the upstream side in the carrying direction (the distance L1 (mm) between the optical sensor 54 and the nozzle #180 is larger than one carry amount). Therefore, when the optical sensor 54 detects a "paperless state," all nozzles of the head 41 are in opposition to the paper, so that ink is ejected from all nozzles. Then, during the dot formation process of the state shown in the figures, the controller determines the nozzles ejecting ink in the next pass, in accordance with the timing when the optical sensor 54 has detected the "paperless state". That is to say, based on the detection result of the optical sensor 54, the controller determines the nozzles that are used during the next pass, such that in the next pass no ink is ejected from nozzles that are further upstream than the lower edge of the paper. Then, after the dot formation process of the state shown in the figures, a further carry process by a predetermined carry amount is performed in order to print the lower edge of the paper.

Then, as shown in FIG. 15C, ink is ejected from the nozzles further downstream than the lower edge of the paper, whereas no ink is ejected from the nozzles further upstream than the lower edge of the paper, thus forming dots on the lower edge of the paper.

With this lower edge process, the amount of ink wasted can be reduced compared to the case that ink is ejected from all nozzles in the state shown in FIG. 15C.

Ejection Testing

<Outline of Ejection Testing>

The downstream-side optical sensor 55 is used when testing whether or not the colored ink and the clear ink described above are properly ejected from the nozzles. This ejection testing is carried out by forming a predetermined test pattern by actually ejecting colored ink and clear ink from the nozzles onto paper. Then, if the test result is that ejection defects, such as clogging of the nozzles, are discovered, then the nozzles are cleaned.

Figure 16:
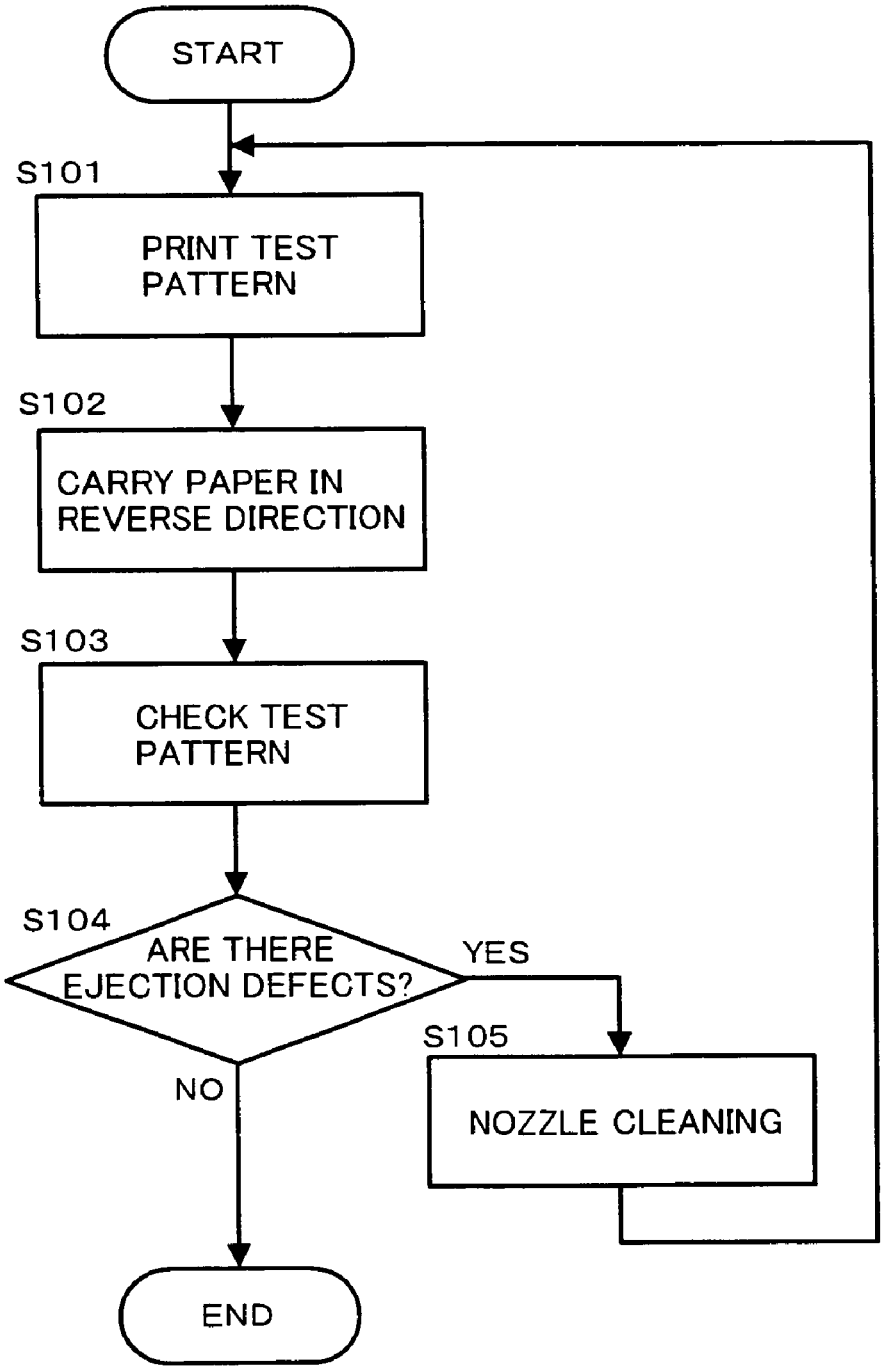
FIG. 16 is a flowchart of the ejection test procedure.

FIG. 16 illustrates an example of an ejection testing procedure. The operations explained below are realized by letting the controller control the units in the printer. The control of the units with the controller follows a program that is stored in a memory. This program is made of code for controlling each of the units.

First, a predetermined test pattern is formed by letting the printer eject colored ink or clear ink onto the paper (S101). The test pattern that is formed here is described in detail further below.

Next, the printer carries the paper in the opposite direction (reverse carry) using the carry unit 20 (102). Thus, the downstream-side optical sensor 55 can be brought into opposition to the pattern formed on the most downstream side in carrying direction (block pattern corresponding to nozzle #1, for example).

Next, the printer inspects the formed test pattern (S103). This inspection is performed using the downstream-side optical sensor 55 mounted to the carriage. It should be noted that the inspection of the test pattern using the downstream-side optical sensor 55 is discussed in greater detail later.

After checking the test pattern, the printer determines, based on the detection result of the downstream-side optical sensor 55, whether or not there are ejection defects of the colored ink or clear ink (S104). If it is determined here that there is an ejection defect, then the printer performs nozzle cleaning (S105). A detailed description of nozzle cleaning is given later. On the other hand, if no ejection defects are discovered, then the printer terminates the ejection test process.

Method for Forming the Colored Ink Test Pattern

1. Regarding the Test Pattern

Figure 17:
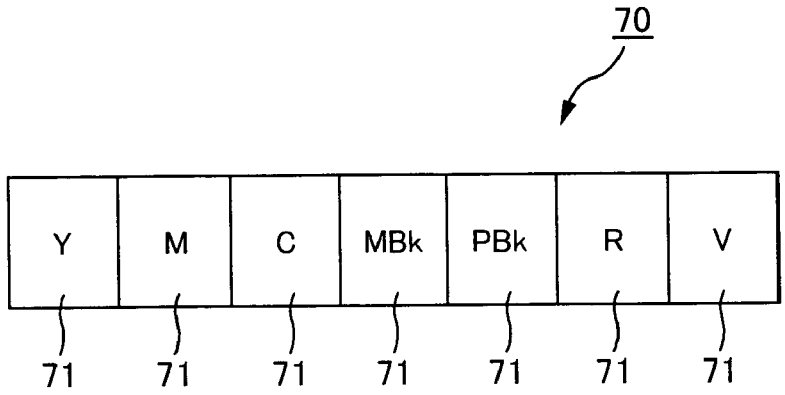
FIG. 17 diagrammatically shows an overall test pattern group 70 used for the ejection test of the nozzles ejecting colored ink.
Figure 18A:
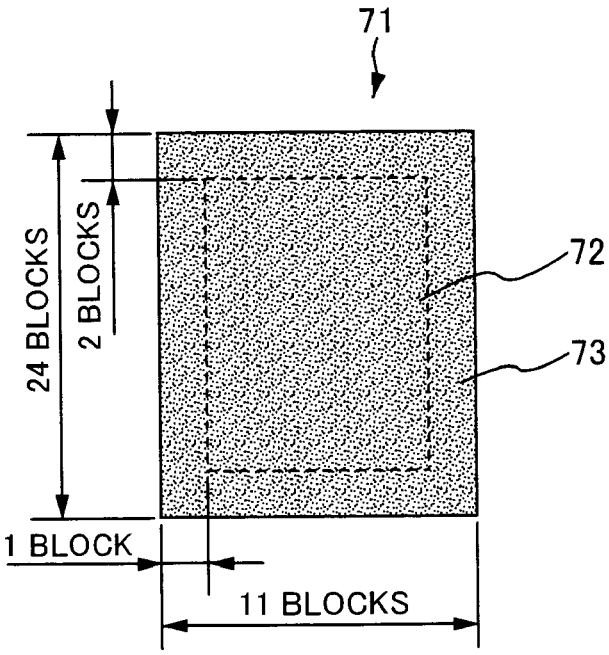
FIG. 18A is an explanatory diagram of one of the test patterns making up the test pattern group.
Figure 18B:
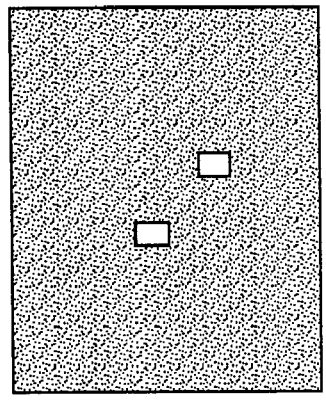
FIG. 18B is an example of a test pattern when there are nozzles that do not eject colored ink.
Figure 19:
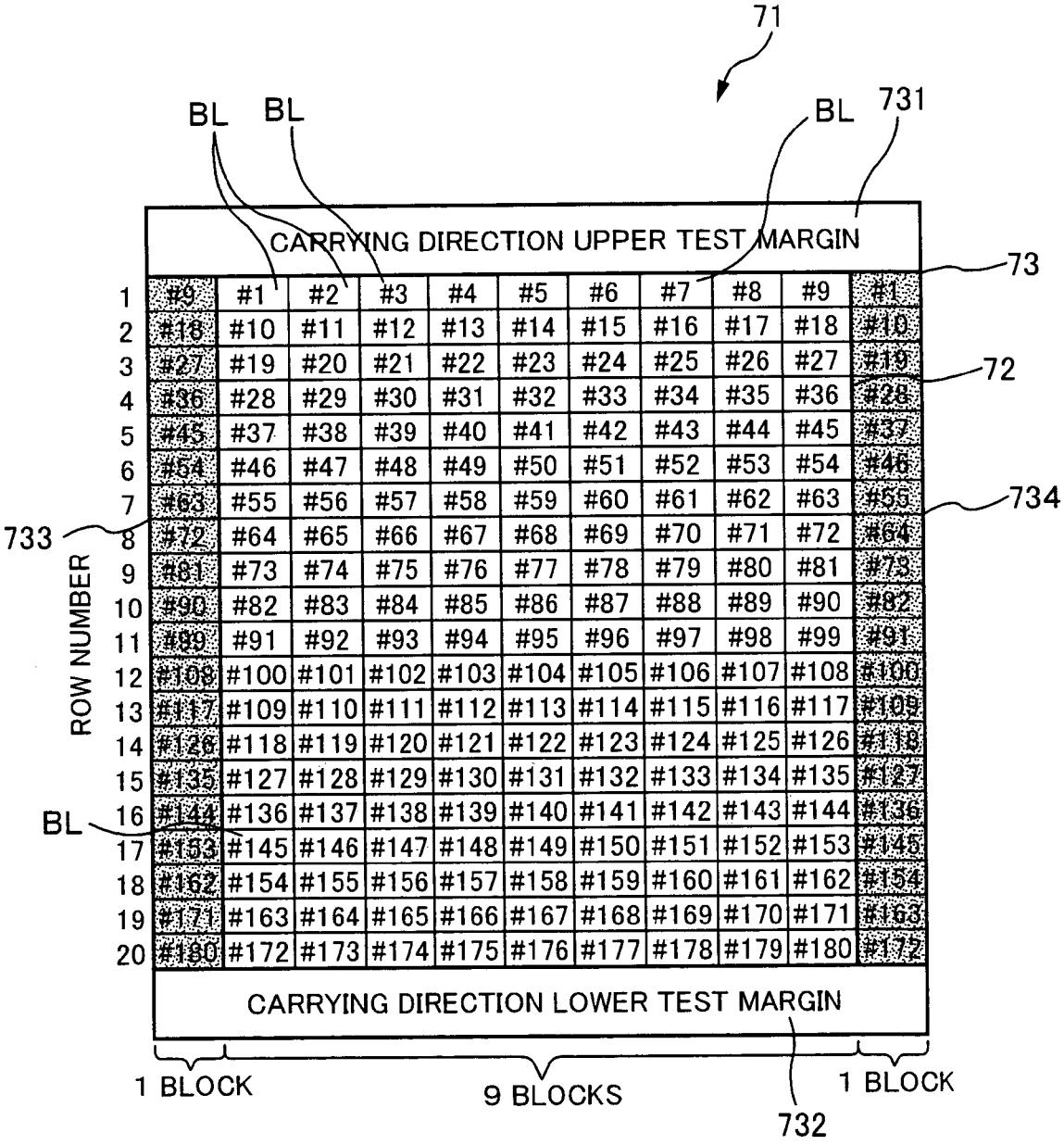
FIG. 19 is an explanatory diagram of the configuration of a test pattern for colored ink.
Figure 20:
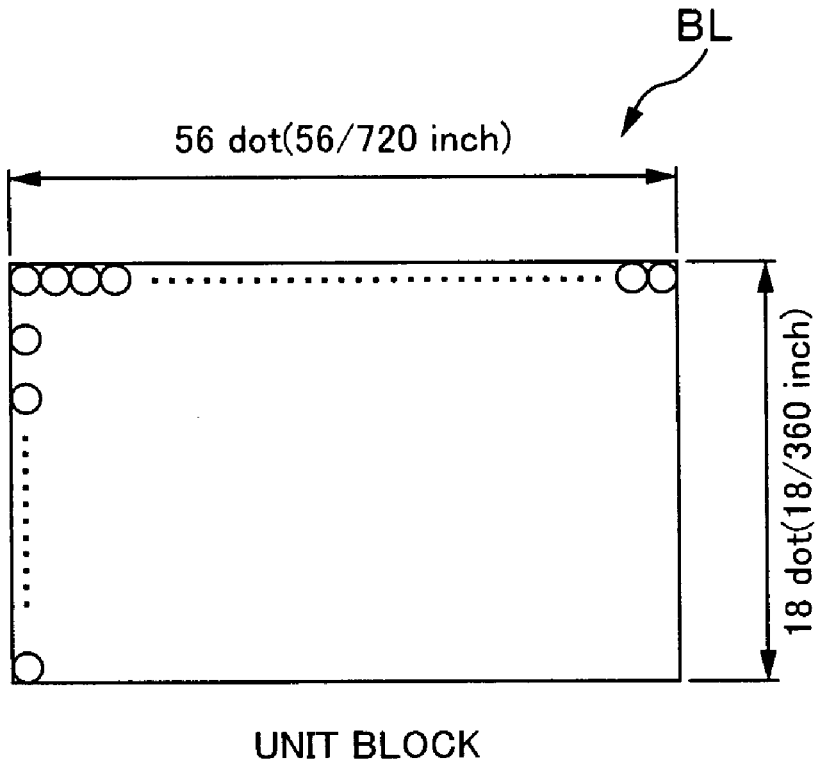
FIG. 20 is an explanatory diagram of a block pattern making up the test patterns.

FIG. 17 diagrammatically shows an overall test pattern group 70 used for the ejection test of the nozzles ejecting colored ink. FIG. 18A is an explanatory diagram of one of the test patterns 71 making up the test pattern group 70. FIG. 18B is an example of a test pattern when there are nozzles that do not eject colored ink. FIG. 19 is an explanatory diagram of the configuration of the colored ink test patterns 71. FIG. 20 is an explanatory diagram of a block pattern BL making up the test patterns 71.

The test pattern group 70 is made of a plurality of test patterns 71. These test patterns 71 are formed adjacent to one another in the scanning direction. Each test pattern is made of a particular ink color. For example, the test pattern 71 labeled "Y" in FIG. 17 is made of yellow ink only. That is, the test pattern 71 labeled "Y" in this drawing is formed by the nozzles ejecting yellow ink. As will be discussed later, this test pattern 71 is used for testing ejection of the nozzles ejecting yellow ink. The test patterns 71 for the other colors have an identical structure.

Each test pattern 71 is made of a tested region 72 and a non-tested region 73. The tested region 72 is made of nine block patterns BL in the scanning direction and 20 block patterns BL in the carrying direction, for a total of 180 block patterns BL. As explained below, every single block pattern BL corresponds to a single nozzle. Thus, the 180 block patterns BL of the tested region 72 are patterns for testing the 180 nozzles. The non-tested region 73 is formed so as to enclose the tested region 72. The non-tested region 73 is made of a carrying direction upper test margin 731, a carrying direction lower test margin 732, a scanning direction left test margin 733 and a scanning direction right test margin 734. These test margins are provided in order to prevent erroneous detection when the downstream-side optical sensor 55 detects the block patterns BL within the tested region 72. That is to say, if there were no non-tested region around the tested region 72, then there might be differences in the detection results between block patterns enclosed by other block patterns formed inside the tested region and block patterns not enclosed by other block patterns formed on the outer edge of the tested region, so that block patterns are also formed to the outer side of the tested region 72.

Each block pattern BL is a rectangular pattern made of 56 dots at a 1/720 inch spacing in the scanning direction and 18 dots at a 1/360 inch spacing in the carrying direction. The dots in any given block pattern BL are formed by ink droplets that are ejected from the same nozzle. For example, the block pattern BL labeled "#1" in FIG. 19 is formed by ink droplets that are ejected from the nozzle #1 only. Thus, each block pattern BL corresponds to a nozzle forming that block pattern BL. If there are non-ejecting nozzles (nozzles that do not eject ink), then, as shown in FIG. 18B, rectangular, blank patterns occur in the test pattern 71. That is, by detecting whether or not there are blank patterns, it is possible to test whether or not there are non-ejecting nozzles. Moreover, by detecting the position of those blank patterns, it is possible to identify the non-ejecting nozzles.

2. Method for Forming a Test Pattern

Figure 21:
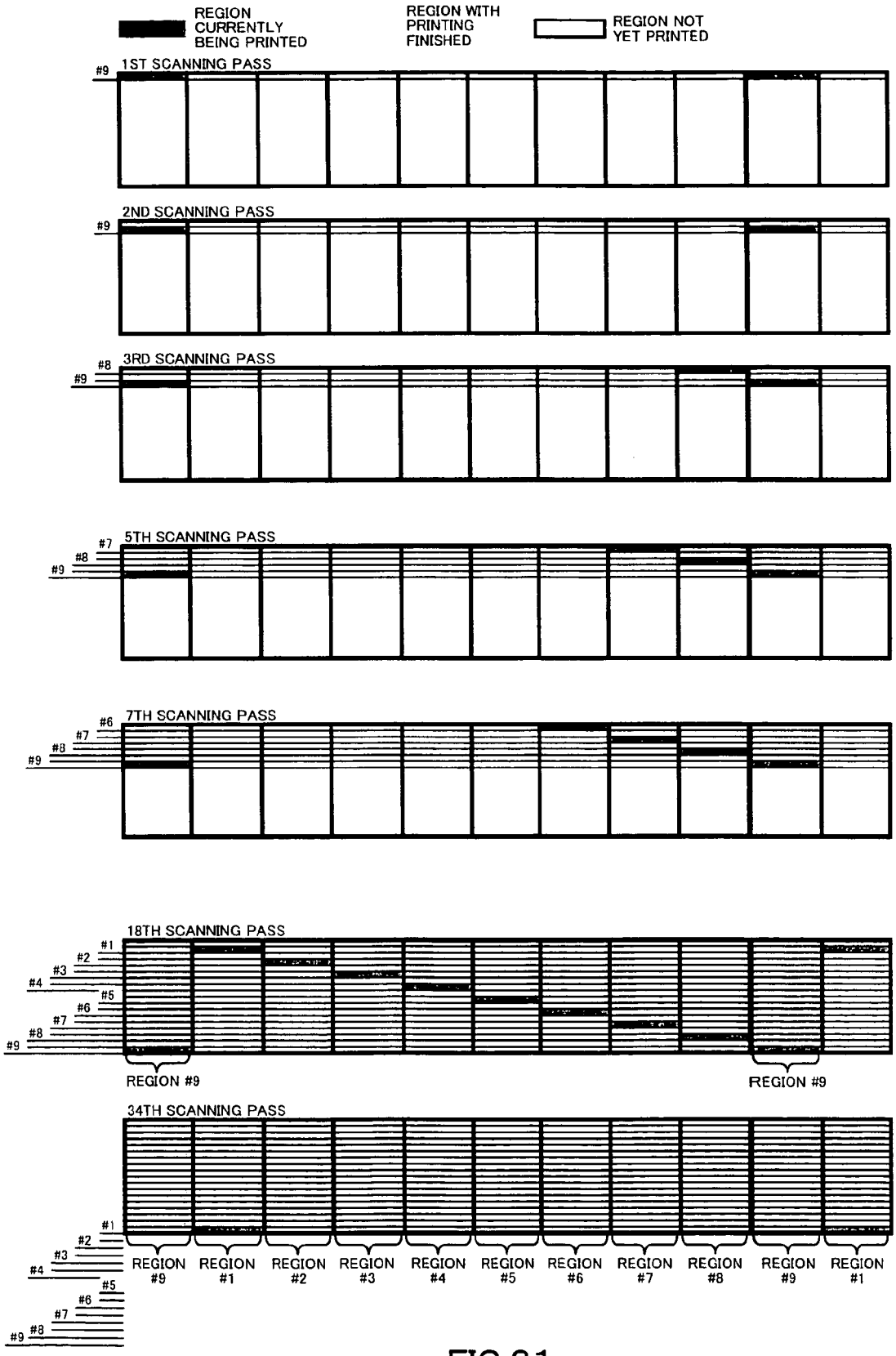
FIG. 21 is an explanatory diagram of the method for forming eleven block patterns.

FIG. 21 is an explanatory diagram of a method for forming the eleven block patterns of the first row of the test pattern 71. The diagram shows the dot rows (the rows of 56 dots lined up in the scanning direction of FIG. 20) that are formed by a single dot formation process (S003: see FIG. 7). Also, the numbers on the left side of the diagram indicate the nozzle numbers, and the positions of the nozzle numbers indicate the positions of the nozzles with respect to the block pattern BL.

First, the print paper is fed until the leading edge position on the carrying direction downstream side of the tested region 72 is in opposition to nozzle #9. Then, the printer executes a first dot formation process, and when the carriage 31 has arrived at a predetermined position, ink is ejected intermittently from nozzle #9. Thus, a dot row is formed at a position on the downstream side of the block pattern corresponding to nozzle #9.

Next, the printer carries the paper by half the nozzle pitch. (1/360 inch) using the carry unit. Then, the printer executes a second dot formation process, and when the carriage has arrived at a predetermined position, ink is ejected intermittently from nozzle #9. Thus, a dot row is formed adjacent on the carrying direction upstream side to the dot row formed in the first dot formation process.

Next, the printer carries the paper by half the nozzle pitch using the carry unit. Then, the printer executes a third dot formation process. In the third dot formation process, the printer intermittently ejects ink from nozzle #9 and nozzle #8. A dot row is formed by the ink ejected from nozzle #9, adjacent on the carrying direction upstream side to the dot row formed in the second dot formation process. Also, a dot row is formed by the ink that is ejected from nozzle #8 at a position on the downstream side of the block pattern BL corresponding to nozzle #8.

Next, the printer carries the paper by half the nozzle pitch using the carry unit. Then, the printer executes a fourth dot formation process. Also in the fourth dot formation process, the printer intermittently ejects ink from nozzle #9 and nozzle #8, forming dot rows adjacent on the carrying direction upstream side to the dot rows formed in the third dot formation process. In this manner, dot formation and carrying are executed to twice form dot rows, while every two dot formation processes the number of nozzles ejecting ink is increased by one from the carrying direction upstream side.

In the 18th dot formation process, the block pattern corresponding to nozzle #9 is completed. Thus, in the 19th dot formation process, the ejection of ink from nozzle #9 is stopped. Thereafter, at every two dot formation processes, the ejection of ink is stopped one nozzle at a time in order from the nozzle positioned on the carrying direction upstream side.

Then, in the 34th dot formation process, the eleven block patterns of the first row of the tested region 72 are completed.

The above description is for a method for forming the eleven block patterns of the first row, which is positioned on the most downstream side in the carrying direction of the test pattern 72, but the eleven block patterns of the other rows are formed at the same time that the eleven block patterns of the first row are formed. That is, the 180 nozzles from nozzle #1 to nozzle #180 are grouped into 20 nozzle groups of nine consecutive nozzles per group, and eleven block patterns are formed by each nozzle group using the same procedure. For example, when a dot row is being formed by nozzle #9, ink is being ejected at identical timing from nozzle #9N (where N is an integer).

The spacing between adjacent block patterns is the same as the dot spacing of the dot rows constituting these block patterns. Therefore, if there are no non-ejecting nozzles, the darkness inside the test patterns 71 becomes uniform, and it is difficult to discern the individual block patterns with the bare eye from the test patterns 71.

<Method for Forming a Clear Ink Test Pattern>

Figure 22:
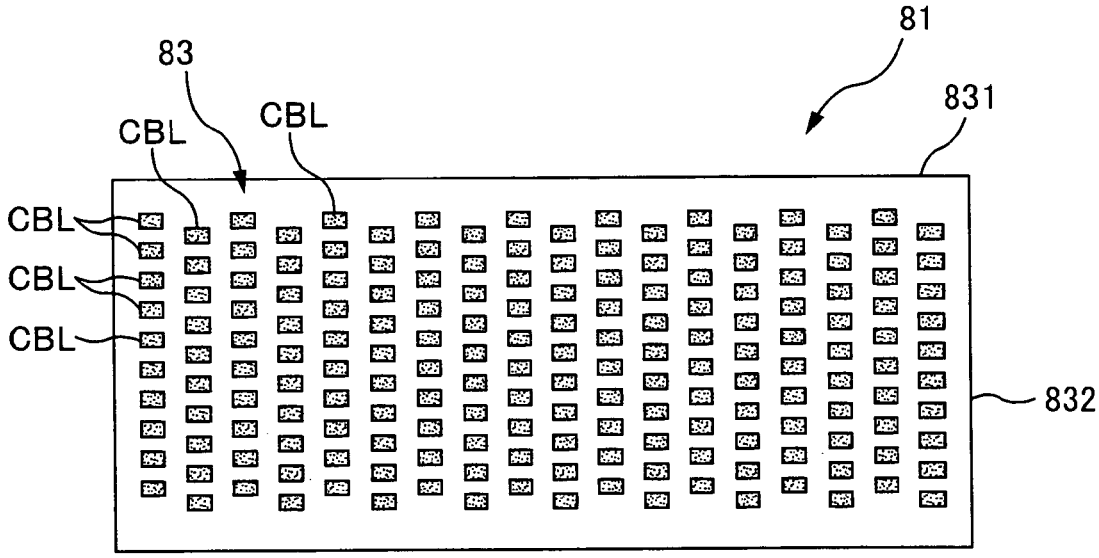
FIG. 22 is an explanatory diagram showing a test pattern for the nozzles ejecting clear ink.
Figure 23:
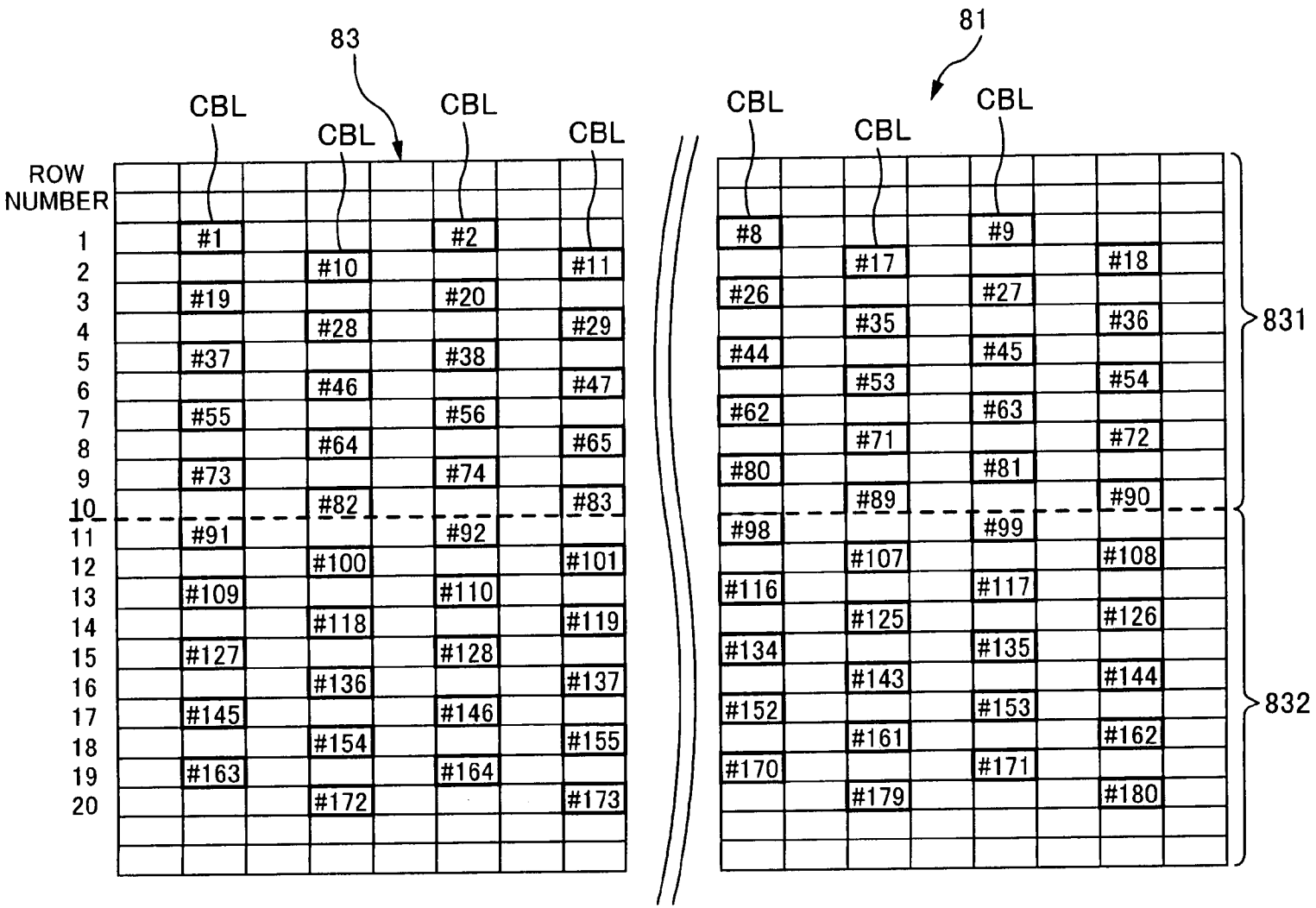
FIG. 23 is an explanatory diagram of the configuration of the clear ink test patterns.
Figure 24A:
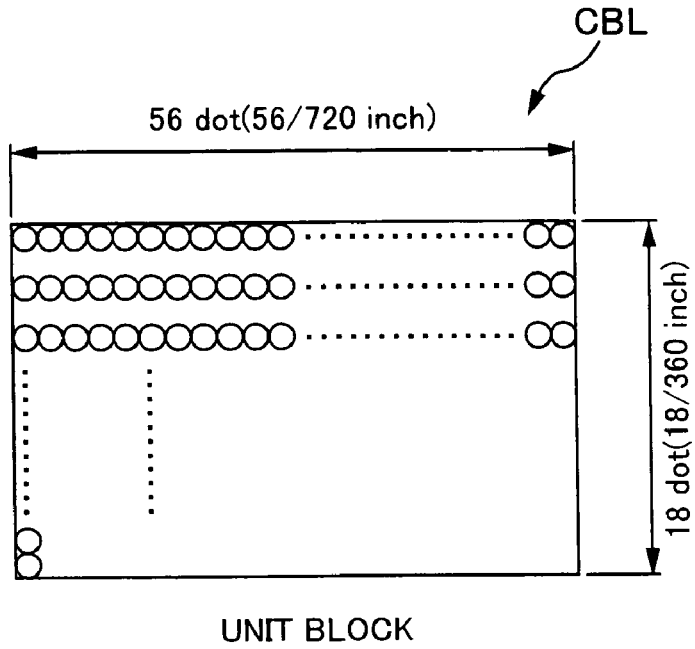
FIG. 24A is an explanatory diagram of a block pattern formed by clear ink.
Figure 24B:
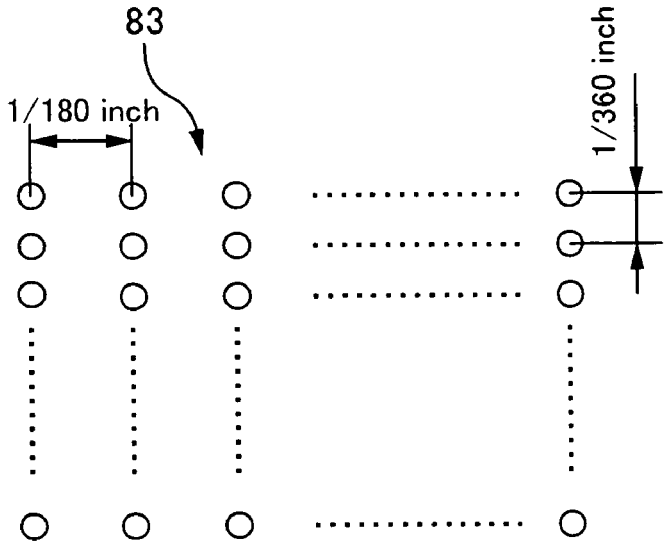
FIG. 24B is an explanatory diagram of a pattern formed by colored ink.
Figure 25A:
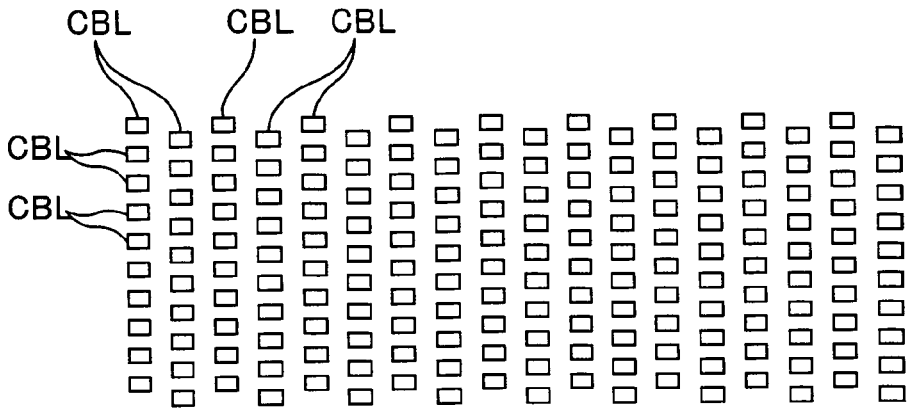
FIG. 25A is an explanatory diagram showing how the block pattern is formed.
Figure 25B:
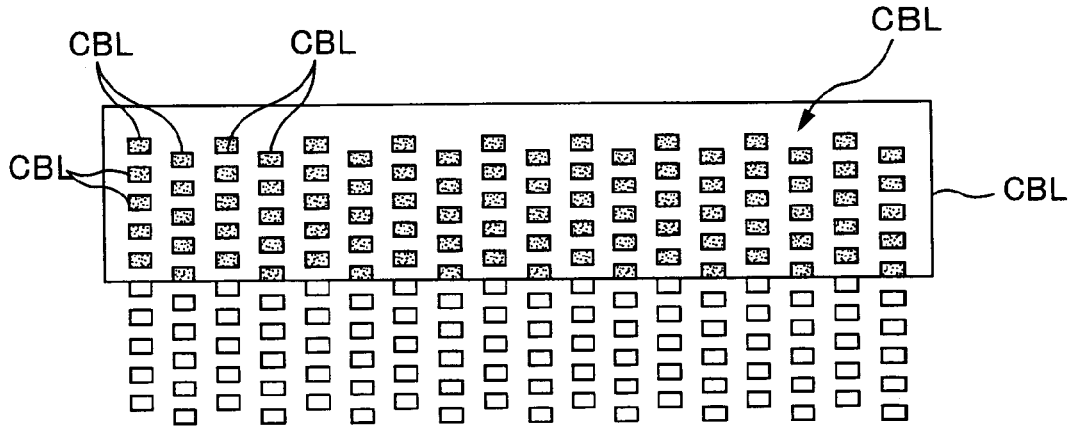
FIG. 25B is an explanatory diagram showing how the pattern formed by colored ink is overlaid over the block pattern.
Figure 25C:
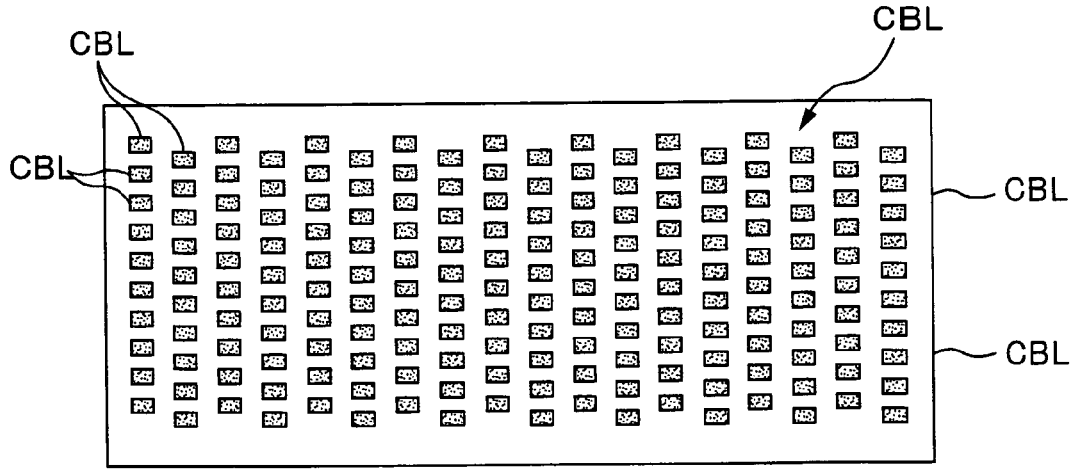
FIG. 25C is an explanatory diagram showing the finished test pattern.

FIG. 22 is an explanatory diagram showing a test pattern 81 for the nozzles ejecting clear ink. FIG. 23 is an explanatory diagram of the configuration of the clear ink test pattern 71. FIG. 24A is an explanatory diagram of a block pattern CBL formed by clear ink. FIG. 24B is an explanatory diagram of a pattern formed by colored ink. FIG. 25A is an explanatory diagram showing how the block patterns CBL are formed. FIG. 25B is an explanatory diagram showing how a pattern formed by colored ink is overlaid over the block patterns CBL. FIG. 25C is an explanatory diagram showing the finished test pattern 81.

The test pattern 81 is formed by overlaying a pattern 83 formed by colored ink over a plurality of block patterns CBL formed by clear ink. As shown in the figure, 180 block patterns CBL are formed by clear ink. The test pattern 81 for clear ink is formed below the above-described test pattern group 70 for colored ink (on the upstream side in carrying direction).

Each block pattern CBL is a rectangular pattern made of 56 dots at a 1/720 inch spacing in the scanning direction and 18 dots at a 1/360 inch spacing in the carrying direction, just like the above-described block patterns BL for the test pattern for colored ink. The dots in any given block pattern CBL are formed by clear ink droplets that are ejected from the same nozzle. For example, the block pattern CBL labeled "#1" in FIG. 23 is formed only by clear ink droplets that are ejected from the nozzle #1. Thus, each block pattern CBL corresponds to a nozzle forming that block pattern CBL. If there is a nozzle that does not eject ink, then there will be a block pattern that is not formed. That is, by detecting whether or not there are block patterns that are not formed, it is possible to test whether or not there are non-ejecting nozzles. Moreover, by detecting the position of those block patterns that are not formed, it is possible to identify the non-ejecting nozzles.

The pattern 83 that is formed by colored ink is formed such that it covers the area over which all block patterns CBL are distributed at a spacing of 1/180 inches in the scanning direction and a spacing of 1/360 inches in the carrying direction. That is to say, the resolution of the colored ink pattern 83 in the scanning direction is lower than the resolution of the block patterns CBL of the clear ink. Moreover, the resolution of the colored ink pattern 83 of the clear ink test pattern 81 is lower than the resolution of the block patterns BL of the test pattern 71 for colored ink nozzles. Since the colored ink pattern 83 has a larger dot spacing, it becomes a comparatively light pattern.

As a method for forming the test pattern 81 for clear ink, the block patterns CBL are formed on the medium by clear ink, and then the colored ink pattern 83 is formed overlaying these block patterns CBL. The method for forming a plurality of block patterns CBL with clear ink is substantially the same as that for the plurality of block patterns BL of the above-described test pattern 71 for colored ink. If a suitable margin is left between the block patterns when forming the block patterns BL, then the plurality of block patterns can be formed with the arrangement shown in FIG. 23. That is to say, the 180 block patterns CBL formed by clear ink are formed by 34 dot formation processes. Then, after the block patterns CBL have been formed, the carry unit carries the paper in reverse direction, and the head 41 forms the colored ink pattern 83 such that it is overlaid over the block patterns CBL. The colored ink pattern 83 is comparatively long in the carrying direction, so that after an upper pattern 831 has been formed by two dot formation processes, a lower pattern 832 is formed by two further dot formation processes (see FIG. 25B).

Figure 26:
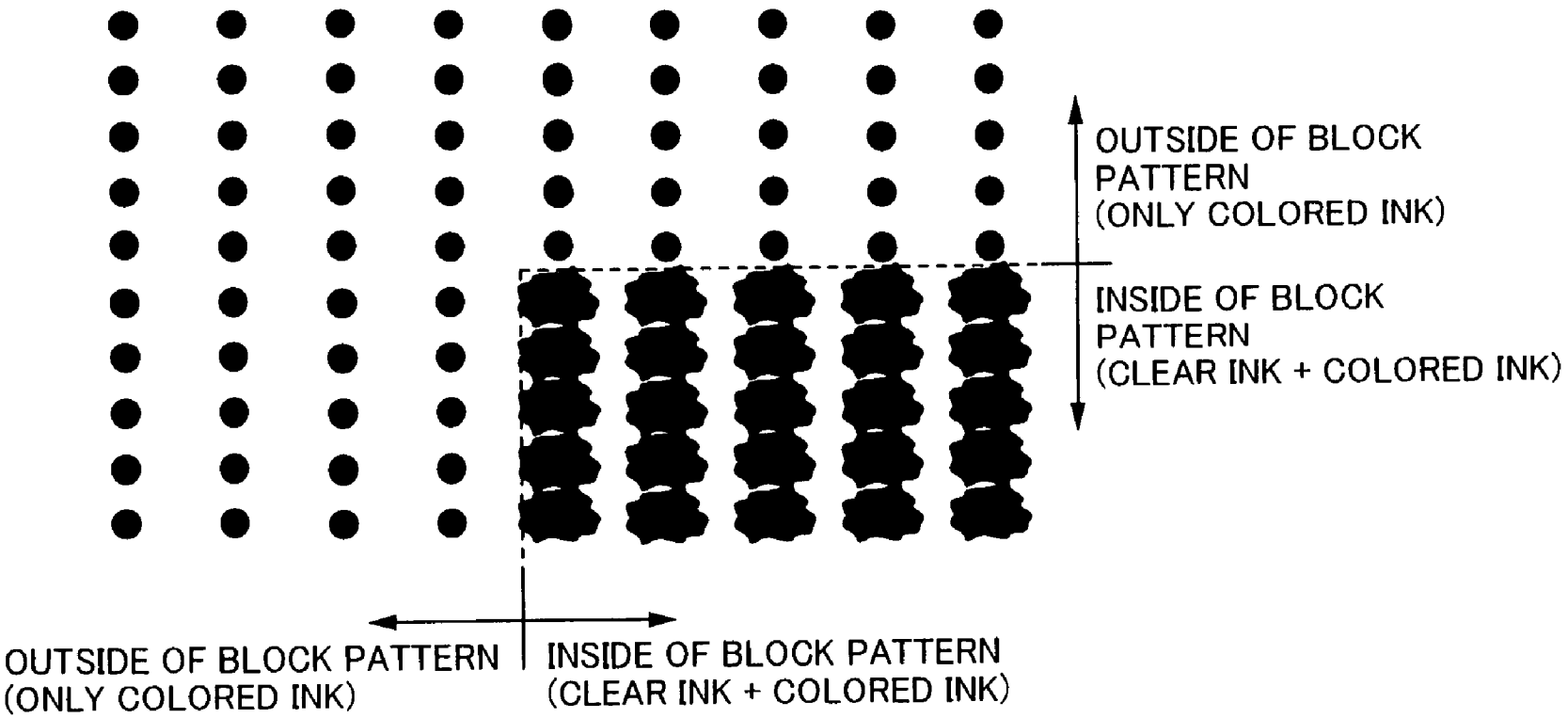
FIG. 26 is an explanatory diagram showing the situation at the upper left of the block patterns of the test pattern.

FIG. 26 is an explanatory diagram showing the situation at the upper left of the block patterns CBL of the test pattern 81. The corner indicated by the dashed line in the figure indicates the upper left corner of a block pattern CBL. Only colored ink droplets land on the paper outside the dashed line in the figure, as can be understood from the method for forming the test pattern described above. Moreover, inside the dashed line in the figure, colored ink droplets land after clear ink droplets land, as can be understood from the method for forming the test pattern described above. When colored ink droplets land on the paper in the region in which no clear ink droplets have landed, the pigments of the colored ink permeate in the thickness direction of the paper forming dots on the paper, just like during regular dot formation. On the other hand, when colored ink droplets land in a region on which clear ink droplets have previously landed, then the colored ink lands on a paper surface that has been wetted by the clear ink so that the colored ink smears. As a result, the color pigments of the colored ink spreads on the paper over a region that is larger than that of ordinary dots (the pigments of the colored ink spread in the in-plane direction of the paper). Thus, the region inside the block patterns CBL becomes darker than the region outside the block patterns CBL (that is, the patterns 83 formed by colored ink only).

When a block pattern is formed by clear ink only, the clear ink is colorless and transparent, so that the downstream-side optical sensor 55 cannot detect the presence of this block pattern formed by clear ink. However, by overlaying a pattern formed by colored ink over the block patterns formed by clear ink, the patterns formed by the colored ink become darker or lighter, and thus the controller can perform an ejection test of the nozzles ejecting clear ink if this pattern's darkness and lightness can be detected.

<Inspecting the Test Patterns>

The inspection of the test patterns (i.e. the test pattern 71 for colored ink and the test pattern 81 for clear ink) is performed by scanning the detection spot of the downstream-side optical sensor by moving the carriage 31 in the scanning direction. Then, the controller repeats, in alternation, a process of scanning the detection spot of the downstream-side optical sensor and a process of carrying the paper in the carrying direction by an amount corresponding to one block, until the inspecting of all test regions of the test patterns is finished. Then, ejection testing for each of the nozzles is performed by detecting whether the block patterns (the block patterns BL and the block patterns CBL) corresponding to the nozzles are present or not.

The following is an explanation of the inspecting of the test patterns.

1. Regarding the Inspection of the Test Pattern for Colored Ink

Figure 27A:
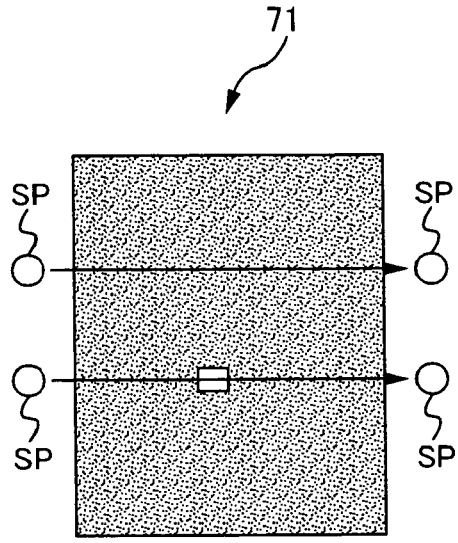
FIG. 27A is an explanatory diagram illustrating the inspection of the colored ink test pattern.
Figure 27B:
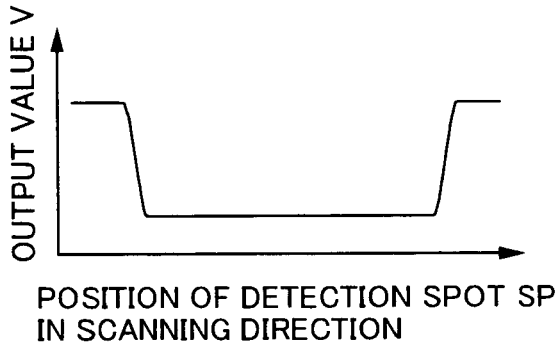
FIG. 27B is an explanatory diagram of the test result of the downstream-side optical sensor for the case that there is no non-ejecting nozzle. FIG.
Figure 27C:
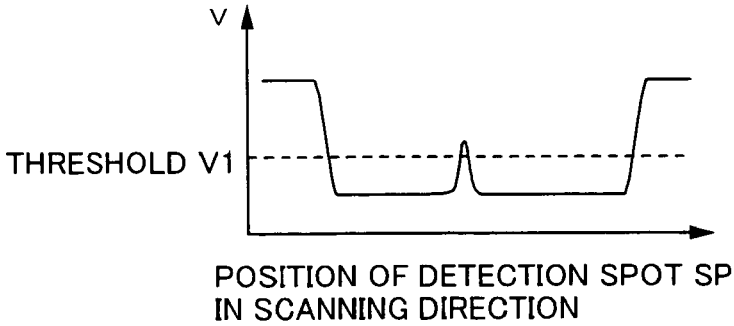

FIG. 27A is an explanatory diagram illustrating the inspection of the colored ink test pattern 71. FIG. 27B is an explanatory diagram of the inspection result of the downstream-side optical sensor 55 for the case that there is no non-ejecting nozzle. FIG. 27C is an explanatory diagram of the inspection result of the downstream-side optical sensor 55 for the case that there is a non-ejecting nozzle. The circular marks SP in the figure denote the detection spots of the downstream-side optical sensor 55.

The inspection of the colored ink test pattern 71 is performed based on the output of the light-receiving section 552 of the downstream-side optical sensor 55. The light-receiving section 552 of the downstream-side optical sensor 55 outputs a higher voltage the greater the amount of light that is received, and outputs a lower voltage the smaller the amount of light that is received.

Since the inspection is performed with the diffuse reflection light measured using the light-receiving section 552 of the downstream-side optical sensor 55, if there is a pattern formed by colored ink inside the detection spot SP, the amount of light received by the light-receiving section 552 is reduced, and the output voltage of the downstream-side optical sensor 55 becomes low. On the other hand, if there is no pattern formed by colored ink inside the detection spot SP, the amount of light received by the light-receiving section 552 increases, and the output voltage of the downstream-side optical sensor 55 becomes high.

When the controller inspects the test pattern, the detection spot SP moves in the scanning direction and traverses the test pattern 71. If there is no blank pattern in the trajectory of the detection spot SP, the downstream-side optical sensor 55 outputs a low voltage while the detection spot SP traverses the test pattern 71. That is to say, if there is no non-ejecting nozzle, the downstream-side optical sensor 55 outputs a low voltage while the detection spot SP traverses the test pattern 71 (see FIG. 27B).

On the other hand, if there is a blank pattern in the trajectory of the detection spot SP, the downstream-side optical sensor 55 outputs a relatively high voltage when the detection spot SP is positioned above that blank pattern. That is to say, if there is a non-ejecting nozzle, the downstream-side optical sensor 55 outputs a relatively high voltage when the detection spot is positioned above the block pattern BL corresponding to that non-ejecting nozzle (see FIG. 27C).

Consequently, if a predetermined threshold value V1 is set in advance, and the controller detects whether or not the output voltage of the downstream-side optical sensor 55 exceeds that threshold value V1 during the inspection of the test pattern 71 (while the detection spot SP traverses the test pattern 71), then the presence of non-ejecting nozzles can be detected. It should be noted that the information regarding the threshold value V1 is stored in advance in the memory. Moreover, if it is counted how many times the output voltage of the downstream-side optical sensor 55 has exceeded the threshold value V1, then it can be detected how many non-ejecting nozzles there are.

Furthermore, based on the position of the detection spot SP at the time that the output voltage of the downstream-side optical sensor 55 exceeds V1, the controller can identify the non-ejecting nozzles. It should be noted that the position of the detection spot SP in the scanning direction can be detected from the output of the linear encoder 51. Also, the position of the detection spot SP in the carrying direction can be detected from the output of the rotary encoder 52. For example, based on a detection result of the downstream-side optical sensor 55 as shown in FIG. 27C, the controller can identify that the non-ejecting nozzle is nozzle #112. It should be noted that in this case, information correlating the position of the block patterns BL and the nozzle number is stored in advance in the memory.

2. Regarding the Inspection of the Clear Ink Test Pattern

FIG. 28A is an explanatory diagram illustrating the inspection of the colored ink test pattern 81. FIG. 28B is an explanatory diagram of the inspection result of the downstream-side optical sensor 55 for the case that there is no non-ejecting nozzle. FIG. 28C is an explanatory diagram of the inspection result of the downstream-side optical sensor 55 for the case that there is a non-ejecting nozzle. The circular marks SP in the figure denote the detection spots of the downstream-side optical sensor 55.

The inspection of the clear ink test pattern 81 is performed based on the output of the light-receiving section 552 of the downstream-side optical sensor 55.

Since the inspection is performed with the diffuse reflection light measured using the light-receiving section 552 of the downstream-side optical sensor 55, if there is a pattern 83 formed only by colored ink inside the detection spot SP, this pattern formed by colored ink only will be comparatively light, so that the amount of light received by the light-receiving section 552 will be comparatively high, and the output voltage of the downstream-side optical sensor 55 will be comparatively high. On the other hand, if there is a block pattern CBL within the detection spot SP, then the colored ink within this block pattern CBL will be smeared, so that its darkness is relatively high, and the amount of light received by the light-receiving section 552 will be comparatively small and the output voltage of the downstream-side optical sensor 55 will be comparatively low. However, if there is a non-ejecting nozzle, then the block pattern CBL corresponding to this nozzle is not formed, so that the pattern formed at this position will be a pattern formed by colored ink only. That is to say, if there is a non-ejecting nozzle, then the pattern at the position corresponding to this nozzle will be relatively light, because the colored ink will not be smeared, so that the amount of light received by the light-receiving section 552 will be comparatively large and the output voltage of the downstream-side optical sensor 55 will be comparatively high.

When the controller inspects the test pattern, the detection spot SP moves in the scanning direction and traverses the test pattern 81. If the detection spot SP is located at a pattern 83 formed by colored ink only, then the downstream-side optical sensor 55 outputs a relatively high voltage (see FIG. 28B). On the other hand, if the detection spot SP is located at a block pattern CBL, then the downstream-side optical sensor 55 outputs a relatively low voltage (see FIG. 28B).

However, if there is a non-ejecting nozzle, then the downstream-side optical sensor 55 outputs a relatively high voltage when the detection spot SP is positioned above the block pattern CBL corresponding to that non-ejecting nozzle (see FIG. 28C).

Consequently, if a predetermined threshold value V2 is set in advance, and the controller counts the number of times that the output voltage of the downstream-side optical sensor 55 undercuts that threshold value V2 during the inspection of the test pattern 81 (while the detection spot SP traverses the test pattern 81), then the presence of non-ejecting nozzles can be detected. That is to say, if there is no non-ejecting nozzle, then the output voltage of the downstream-side optical sensor 55 will be lower than V2 on nine occasions per scanning pass (see FIG. 28B). However, if there is a non-ejecting nozzle, then the output voltage of the downstream-side optical sensor 55 will be lower than V2 on fewer occasions per scanning pass (see FIG. 28C).

Moreover, if information regarding the positions of the block patterns CBL is stored in advance in the memory, then the controller can detect the presence of non-ejecting nozzles based on the output voltage of the downstream-side optical sensor 55 when the detection spot SP is at the position of those block patterns CBL. That is to say, if the detection spot SP is at the position of a given block pattern CBL, and the output voltage of the downstream-side optical sensor 55 is higher than the threshold V2, then the block pattern CBL of that position has not been formed, so that the presence of a non-ejecting nozzle is detected. Moreover, if information associating the position of the block patterns CBL and the nozzle numbers is stored in advance in the memory, then the non-ejecting nozzles can be specified. For example, based on detection results of the downstream-side optical sensor 55 as shown in FIG. 28C, the controller can specify that the nozzle #104, which corresponds to the fifth block pattern CBL from the left in the twelfth row from the top, is a non-ejecting nozzle.

<Nozzle Cleaning>

If the result of the inspection of the test patterns is that there are non-ejecting nozzles, then the controller executes a cleaning process in order to rectify the ejection defects. Here, the following two types of cleaning processes performed by the controller are possible. However, the cleaning processes are not limited to these, and other methods are possible as well. That is to say, it is sufficient if it is a process that clears the clogging of nozzles to be an ejection defect.

1. Regarding Nozzle Suction

Nozzle suction is a process of clearing ejection defects, such as nozzle clogging, by forcibly sucking ink from the nozzles. When the carriage 31 is in the standby position, the head 41 is covered by a cap. In this situation, the controller applies a negative pressure to the cap through a pump, and sucks out the ink within the nozzles.

2. Regarding Flushing

Flushing is a process of clearing ejection defects, such as nozzle clogging, by forcibly ejecting ink from the nozzles. Outside the print region, the controller drives the piezo elements and ejects ink from the nozzles. Different to the ejection of ink during printing, the ink ejected during flushing does not land on the paper, but is collected by a collection mechanism not shown in the drawings. If the non-ejecting nozzle is specified, then it is also possible to let only that nozzle eject ink. In this manner, waste of ink can be prevented.

Correction of Ejection Timing

FIG. 29 is an explanatory diagram illustrating the adjustment of the ejection timing. The carriage 31 can be moved back and forth in the scanning direction. Then, while the carriage moves back and forth, ink is ejected from the nozzles and lands on the paper. Since there is a gap between the nozzles and the paper S, even if the ink lands at the same target landing position on the paper, the positions (timings) at which the ink is ejected in the forward pass and the return pass will be different. Furthermore, the ejection position of the ink in the forward pass and the return pass will depend on the speed of the ink droplets ejected from the nozzles, and on the spacing between the nozzles and the paper. Accordingly, it is necessary to adjust the timing with which the ink is ejected from the nozzles.

In order to correct the ejecting timing, a correction pattern is formed on the paper by ejecting ink from the nozzles, and the downstream-side optical sensor detects this correction pattern. Then, based on the detection results of the downstream-side optical sensor, the positions (timings) at which ink is ejected are corrected.

FIGS. 30A to 30C are explanatory diagrams illustrating ink ejecting timing correction patterns. FIG. 30A is a forward pass pattern formed by ink that is ejected from nozzles during the forward pass. FIG. 30B is a return pass pattern formed by ink that is ejected from nozzles during the return pass. FIG. 30C is a correction pattern formed by overlaying the forward pass pattern and the return pass pattern.

The forward pass pattern and the return pass pattern are each constituted by five patterns. Each pattern group is formed by arranging a plurality of rectangular patterns in alternation, thus forming a checkerboard pattern. The rectangles forming this checkerboard pattern are smaller than the detection spot of the downstream-side optical sensor 55.

The spacing between the five pattern groups of the return pass is different from the spacing between the five pattern groups of the forward pass. Thus, if the third pattern groups is taken as a reference, the second pattern group of the return pass pattern is offset by $\alpha$ to the left in the figure from the second pattern group of the forward pass, and the first pattern group of the return pass pattern is offset by $2\alpha$ to the left in the figure from the first pattern group of the forward pass. Similarly, if the third pattern groups is taken as a reference, the fourth pattern group of the return pass pattern is offset by $\alpha$ to the right in the figure from the fourth pattern group of the forward pass, and the fifth pattern group of the return pass pattern is offset by $2\alpha$ to the right in the figure from the fifth pattern group of the forward pass.

Patterns with high darkness and patterns with low darkness are formed on the correction pattern formed by overlaying the forward pass pattern and the return pass pattern. In the patterns with high darkness, the black portions of the checkerboard pattern of the return pass are formed over the white portions of the checkerboard pattern of the forward pass. That is to say, in the dark patterns, the ink landing positions in the forward pass can be thought to be offset against the ink landing positions in the return pass. On the other hand, in the light patterns, the checkerboard patterns of the forward pass and the return pass are matched. That is to say, in the light patterns, the ink landing positions in the forward pass can be thought to match the ink landing positions in the return pass.

This means that if the darkness of the correction pattern is detected with the downstream-side optical sensor 55 and the pattern group constituting the light pattern is specified, then it is possible to determine the position at which ink is ejected. For example, in the figure, the offset amount of the ink ejection position of the return pass with respect to the forward pass is determined to be the offset amount of the ejection position of the return pass to the forward pass when the third pattern is formed. If the pattern formed by the second pattern group of the correction pattern is light, then the ejection position of the ink of the return pass with respect to the forward pass is corrected to a position that is shifted by $\alpha$ to the left, in comparison with the case described above.

Discriminating the Paper Type

The thickness of paper depends on the paper type. When the thickness of the paper differs, then also the height of the detection spot of the upstream-side optical sensor 54 differs, so that the amount of regular reflection light received by the light-receiving section 541 also differs. That is to say, it is possible to discriminate the paper type based on the detection result of the upstream-side optical sensor 54.

Also the surface state (for example, the surface roughness or color) of the paper depends on the paper type. When the surface state of the paper differs, also the diffuse reflection light when irradiating light will differ. That is to say, it is possible to discriminate the paper type based on the detection result of the downstream-side optical sensor 55.

It should be noted, however, that since there are a lot of different print paper types, there can be papers of different types having the same thickness or a similar surface state.

Accordingly, in the present embodiment, the paper type is discriminated based on the detection result of the two sensors, the upstream-side optical sensor 54 and the downstream-side optical sensor 55. Thus, it is possible to increase the number of paper types that can be discriminated.

Incidentally, also the optimal ink amount that should be applied depends on the paper type. For example, if the printer is used to print on plain paper, then it is necessary to reduce the ink ejection amount in comparison to special purpose paper.

Accordingly, in the present embodiment, after the paper type has been discriminated, the controller controls the ejection of ink from the nozzles in accordance with the result of this discrimination. It should be noted that in a case that paper type information (information regarding the paper type) is included in the print data received from the computer side, then it is also possible to let the controller compare the paper type determined by the printer with the paper type information contained in the print data, and then to carry on with the printing if they match, or to display a warning for the user if they do not match.

Other Embodiments

The above embodiment was described primarily with regard to a printer, but the above embodiment of course also includes the disclosure of a pattern inspecting method and a printing system, for example.

Also, a printer, for example, serving as an embodiment was described above. However, the foregoing embodiment is for the purpose of elucidating the present invention and is not to be interpreted as limiting the present invention. The invention can of course be altered and improved without departing from the gist thereof and includes functional equivalents. In particular, the embodiments mentioned below are also included in the invention.

<Regarding the Sensor>

In the foregoing embodiment, the downstream-side optical sensor 55 receives only diffuse reflection light. However, the downstream-side optical sensor 55 is not limited this configuration.

FIG. 31 shows a downstream-side optical sensor 55 according to a different embodiment. This downstream-side optical sensor includes a light-emitting section 551, a first light-receiving section 552, and a second light-receiving section 553. The fact that it includes this second light-receiving section 553 is what differentiates this sensor from the above-described embodiment. The second light-receiving section 553 receives the regular reflection light of the light irradiated by the light-receiving section 551 onto the paper. Also when the downstream-side optical sensor 55 has this configuration, it can detect the test patterns formed by the nozzles.

Incidentally, to test the ejection of clear ink, the above-described embodiment formed the test pattern 81 using colored ink and clear ink, and the downstream-side optical sensor 55 detected this test pattern 55 using diffuse reflection light. However, the test pattern 81 requires a larger amount of ink than the test pattern 71. On the other hand, if the test pattern 71 is formed using clear ink only, then the test pattern cannot be detected with diffuse reflection light, since clear ink is a colorless transparent liquid. However, if the test pattern 71 is formed only with clear ink on glossy paper, then the amount of regular reflection light in the region on which the clear ink is applied becomes large, so that it is possible to detect the test pattern using regular reflection light. Therefore, if the downstream-side optical sensor 55 of the present embodiment is used, it is possible to detect test patterns formed only by clear ink on glossy paper, with the second light-receiving section 553. Thus, it is possible to reduce the amount of ink consumed.

It is furthermore possible to let also the upstream-side optical sensor 54 receive not only regular reflection light but also diffuse reflection light.

<Attachment Position of the Sensors (1)>

In the above-described embodiment, the sensors (that is, the upstream-side optical sensor 54 and the downstream-side optical sensor) are attached to the carriage. However, the attachment position of the sensors is not limited to this. For example, it is also possible to attach the sensors to the head 41. Also in this case, the sensors can be moved together with the head 41.

<Attachment Position of the Sensors (2)>

In the above-described embodiment, the upstream-side optical sensor 54 is disposed further upstream in the carrying direction than the nozzle #180 that is located most upstream. Thus, the upstream-side optical sensor 54 can detect the upper edge and the lower edge of the paper before the upper edge and the lower edge of the paper reaches the nozzles.

However, the attachment position of the upstream-side optical sensor 54 is not limited to this. For example, it is also possible that it is located further downstream than the nozzle #180 that is located most upstream. Also when the upstream-side optical sensor is attached at this position, it is possible to detect the upper edge and the lower edge of the paper at a more suitable position than to detect the upper edge and the lower edge of the paper with the downstream-side optical sensor 55. Moreover, if the upstream-side optical sensor 54 is disposed at such a position, then it is possible to diminish the size of the carriage 31 in the carrying direction.

<Attachment Position of the Sensors (3)>

In the above-described embodiment, the downstream-side optical sensor 55 is disposed further upstream in the carrying direction than the nozzle #1 that is located most downstream. In this way, the size of the carriage 31 in the carrying direction can be reduced.

However, the attachment position of the downstream-side optical sensor 55 is not limited to this. For example, it is also possible that it is located further downstream than the nozzle #1 that is located most downstream. Also when the downstream-side optical sensor 55 is attached at this position, it is possible to detect patterns at a more suitable position than to detect test patterns or correction patterns with the upstream-side optical sensor 54. Moreover, if the downstream-side optical sensor 55 is disposed at this position, then it becomes unnecessary to carry the paper in reverse direction when detecting the test pattern with the downstream-side optical sensor 55, for example, so that the inspection time can be shortened.

<Regarding the Nozzles>

In the foregoing embodiment, ink was ejected using piezoelectric elements. However, the method for ejecting liquid is not limited to this. Other methods, such as a method for generating bubbles in the nozzles through heat, can also be employed.

<Regarding the Colored Ink>

In the foregoing embodiment, yellow (Y), magenta (M), cyan (C), black (K) (here, "black" is the general term for matte black (MBk) and photo black (PBk)), red (R), and violet (V) ink are used as colored inks. However, the colored inks that are used are not limited to this. For example, it is also possible to use light magenta, light cyan, dark yellow or other colored inks.

<Regarding the Medium>

In the above-described embodiment, plain paper or glossy paper was used as the medium. However, the medium on which the test patterns can be formed is not limited to this. For example, the test patterns can be formed on a variety of media, as shown in FIG. 3. Moreover, the printer forms the test patterns in accordance with the type of medium, such that the downstream-side optical sensor can detect the test patterns.

Overview

FIGS. 32A and 32B are explanatory diagrams of the configuration of comparative examples. FIG. 32C is a simplified explanatory diagram of the configuration of the sensors of an embodiment of the present invention. Comparing the comparative examples to this embodiment, the carriage 31 is provided with only one sensor in the comparative examples, whereas the carriage 31 is provided with two sensors in the present embodiment. Furthermore, the one sensor in the comparative examples can detect regular reflection light and diffuse reflection light, whereas the present embodiment differs in that the upstream-side optical sensor can detect only regular reflection light and the downstream-side optical sensor can detect only diffuse reflection light.

(1) The printer (printing apparatus) of the above-described embodiment comprises a head 41 that can perform printing (recording) on a paper (medium) using ink, an upstream-side optical sensor 54 (first sensor) that can be moved together with the head 41 and that detects regular reflection light from the paper, and a downstream-side optical sensor 55 that is provided separately from the upstream-side optical sensor 54, that can be moved together with the head 41, and that can detect diffuse reflection light from the paper.

The following is a discussion of configurations in which only one of the sensors is provided. If only the upstream-side optical sensor 54 were to be provided, then it would not be capable of detecting the diffuse reflection light from the medium, so that it would not be possible to detect patterns formed on the paper, for example. And if only the downstream-side optical sensor were to be provided, then it would not be capable of detecting the regular reflection light from the medium, so that it would not be possible to detect the edges of the paper, for example.

The following is a discussion of a configuration in which only one sensor that can detect both regular reflection light and diffuse reflection light were to be provided. In that case, it would be possible to detect a number of features (such as the edges of the paper carried by the carry unit 20 or the patterns formed on the paper by the head, for example), but if such a sensor is used, the detection positions would be the same. As a result, the operations before and after detection are slowed down, and it is not always possible to detect the feature to be detected at the optimum position.

On the other hand, in the printer of the present embodiment, the downstream-side optical sensor 55 is provided separately from the upstream-side optical sensor, as shown in FIG. 32C. That is to say, in the present embodiment, different types of sensors are provided at different positions. Thus, each sensor can fulfill a different role, and the number of features that can be detected can be increased. Furthermore, with the present embodiment, the detected features can be detected at optimum positions, so that the operation before and after the detection can speed up and the precision can be improved. Furthermore, the configuration of the sensors can be simplified, so that the costs can be lowered.

(2) The printer (printing apparatus) of the above-described embodiment is provided with a carry unit 20 that carries the paper (medium) in the carrying direction, and a movable head 41 that can perform recording on the paper using ink. With such a printer, it is desirable to detect the position of the edges of the paper that is carried by the carry unit 20, and to detect the pattern that is formed on the paper by the head.

Here, a sensor that can detect regular reflection light and diffuse reflection light can detect the position of the edges of the paper that is carried by the carry unit 20, and can also detect the pattern that is formed on the paper by the head. However, if such a sensor is used, then the position where the edge of the paper is detected is the same position as the position where the pattern formed on the paper is detected.

If a sensor detecting regular reflection light as well as diffuse reflection light were to be provided upstream in the carrying direction from the head 41, as shown in FIG. 32A, then it would be necessary to reverse carry (backfeed) the paper for a large amount for the sensor to detect the pattern formed on the paper. However, if the reverse carry amount is large, then the time needed from the formation of the pattern on the paper to the detection of that pattern with the sensor will be long.

Also, if a sensor detecting regular reflection light as well as diffuse reflection light were to be provided downstream in the carrying direction from the head, as shown in FIG. 32B, then the position at which the upper edge and the lower edge of the paper are detected would be on the downstream side. Therefore, when the position at which the upper edge of the paper is detected is further downstream in the carrying direction than the print start position, then it is necessary to reverse carry the paper when carrying the paper to the print start position. However, when such a reverse carry is performed, the paper cannot be accurately positioned at the print start position due to the influence of backlash. Moreover, the position at which the lower edge of the paper is detected is further downstream than the nozzle #180. That is to say, when the sensor detects the lower edge of the paper, this lower edge of the paper has passed most of the print region. Therefore, it is not possible to perform the above-described lower edge process with this sensor arrangement.

By contrast, the printer (printing apparatus) of the present embodiment, as shown in FIG. 32C, is provided with the upstream-side optical sensor 54 (first sensor), which can be moved together with the head 41 and which detects the edges of the paper, and the downstream-side optical sensor 55 (second sensor), which can be moved together with the head 41 and which detects the patterns formed on the paper. Moreover, the upstream-side optical sensor 54 is provided further upstream in the carrying direction than the downstream-side optical sensor 55.

Thus, with the present embodiment, "the sensor detecting the edge of the paper" and "the sensor detecting the patterns" are provided separately with respect to the carrying direction, and each sensor fulfills a different role. Moreover, "the position at which the edges of the paper are detected" is positioned further upstream in the carrying direction than "the position at which the patterns are detected." Thus, with the present embodiment, the detected items can be detected at optimum positions, so that the operations before and after the detection can speed up and the precision can be improved. Furthermore, the configuration of the sensors can be simplified, so that the costs can be lowered.

(3) With the above-described embodiment, the upstream-side optical sensor 54 (first sensor) is provided further upstream in the carrying direction in which the paper (medium) is carried than the downstream-side optical sensor (second sensor).

If a sensor detecting regular reflection light as well as diffuse reflection light were to be provided upstream in the carrying direction from the head 41, as shown in FIG. 32A, then it would be necessary to reverse carry (backfeed) the paper for a large amount for the sensor to detect the pattern formed on the paper. However, if the reverse carry amount is large, then the time needed from the formation of the pattern on the paper to the detection of that pattern with the sensor will be long.

Also, if a sensor detecting regular reflection light as well as diffuse reflection light were to be provided downstream in the carrying direction from the head, as shown in FIG. 32B, then the position at which the upper edge and the lower edge of the paper are detected would be on the downstream side. Therefore, for example, when the position at which the upper edge of the paper is detected is further downstream in the carrying direction than the print start position, then it is necessary to reverse carry the paper when carrying the paper to the print start position. However, when such a reverse carry is performed, the paper cannot be accurately positioned at the print start position due to the influence of backlash. Moreover, the position at which the lower edge of the paper is detected is further downstream than the nozzle #180. That is to say, when the sensor detects the lower edge of the paper, this lower edge of the paper has passed most of the print region. Therefore, it is not possible to perform the above-described lower edge process with this sensor arrangement.

By contrast, in the printer (printing apparatus) of the present embodiment, the upstream-side optical sensor 54 is provided further upstream in the carrying direction than the downstream-side optical sensor 55. Thus, with the present embodiment, the upstream-side optical sensor and the downstream-side optical sensor are provided separately in the carrying direction, and each sensor fulfills a different role. As a result, for example, "the position at which the edge of the paper is detected" is positioned further upstream in the carrying direction than "the position at which the patterns are detected." Thus, with the present embodiment, the detected features can be detected at optimum positions, so that the operations before and after the detection can speed up and the precision can be improved.

(4) In the above-described embodiment, the upstream-side optical sensor 54 (first sensor) includes a light-emitting section 541 and a light-receiving section 542. Moreover, also the downstream-side optical sensor 55 (second sensor) includes a light-emitting section 551 and a light-receiving section 552. Furthermore, the direction in which the light-emitting section 541 and the light-receiving section 542 of the upstream-side optical sensor are arranged is different from the direction in which the light-emitting section 551 and 552 of the downstream-side optical sensor 54 are arranged.

The light-emitting section 541 and the light-receiving section 542 of the upstream-side optical sensor 54 are arranged in the carrying direction for example (see FIG. 9). That is to say, the light-emitting section of the upstream-side optical sensor 54 irradiates light onto the paper from a direction that coincides with the carrying direction. As a result, the detection spot has an elliptical shape with a long axis extending in the carrying direction (even though to simplify the explanations of the above-described embodiment, the detection spot was explained to be circular.) Thus, compared with the case that the detection spot is circular, the upstream-side optical sensor 54 has a higher sensitivity when detecting the lateral edges of the paper. That is to say, if the detection spot shown in FIG. 10 is elliptical with its long axis extending in the lateral direction of the figure, then State A and State D come closer together than in the case that the detection spot is circular, thus increasing the sensitivity of the sensor.

On the other hand, the light-emitting section 551 and the light-receiving section 552 of the downstream-side optical sensor 54 are arranged in the scanning direction for example (see FIG. 11). As a result, the detection spot has an elliptical shape with a long axis extending in the scanning direction (even though to simplify the explanations of the above-described embodiment, the detection spot was explained to be circular.) Thus, the downstream-side optical sensor 54 can detect the block patterns, which are rectangular and extend in the scanning direction, with high precision.

In this manner, depending on the feature to be detected, there are suitable directions for the light that is irradiated by the light-emitting sections. In the present embodiment, the directions in which the light-emitting section and the light-receiving section of the upstream-side optical sensor 54 and the downstream-side optical sensor 55 are arranged are different, so that the arrangement of the light-emitting section and the light-receiving section can be optimized with regard to the application of the respective sensor.

(5) In the above-described embodiment, the light-emitting section 541 and the light-receiving section 542 of the upstream-side optical sensor 54 (first sensor) are arranged in the carrying direction (the direction in which the medium is carried). Moreover, the light-emitting section 551 and 552 of the downstream-side optical sensor 55 (second sensor) are arranged in the scanning direction (the direction in which the head 41 is moved).

Thus, as noted above, the upstream-side optical sensor 54 can detect the lateral edges of the paper with high precision, and the downstream-side optical sensor 55 can detect the patterns formed on the paper with high precision.

(6) In the above-described embodiment, the upstream-side optical sensor 54 (first sensor) is a sensor for detecting the edges of the paper (medium). The upstream-side optical sensor 54 detects regular reflection light, so that it is advantageous for detecting the presence of paper. Therefore, the upstream-side optical sensor 54 can detect the edges of the paper with higher precision than the downstream-side optical sensor 55, which detects diffuse reflection light.

(7) In the above-described embodiment, the downstream-side optical sensor 55 (second sensor) is a sensor for detecting patterns formed by the head 41 on the paper (medium). The downstream-side optical sensor 55 detects diffuse reflection light, so that it is advantageous for detecting degrees of darkness to be detected. Therefore, the downstream-side optical sensor 55 can detect patterns with higher precision than the upstream-side optical sensor, which detects regular reflection light.

(8) In the above-described embodiment, the upstream-side optical sensor 54 (first sensor) includes a light-emitting section 541 and a light-receiving section 542. Moreover, the light-emitting section of the upstream-side optical sensor 54 irradiates light onto the medium, whereas the light-receiving section 542 of the upstream-side optical sensor 54 receives the regular reflection light from the paper. Thus, the upstream-side optical sensor 54 can detect the presence of paper in the detection spot, and as a result, can detect the edges of the paper.

However, the sensor for detecting the edges of the paper is not limited to one using the regular reflection light. For example, it may also be one detecting the edges of the paper mechanically, like the paper detection sensor 53. Furthermore, it may also be an optical sensor not using regular reflection light, such as in a CCD camera.

(9) In the above-described embodiment, the downstream-side optical sensor 55 (second sensor) includes a light-emitting section 551 and a light-receiving section 552. Thus, the downstream-side optical sensor 55 can detect the density of the pattern in the detection spot.

However, the sensor for detecting the pattern is not limited to one using diffuse reflection light. For example, it is also possible to detect patterns magnetically. Furthermore, it can also be an optical sensor not using regular reflection light, such as in a CCD camera.

(10-1) In the above-described embodiment, the carry unit is controlled in accordance with the detection result of the upstream-side optical sensor 54 (first sensor). For example, the upper edge of the paper is detected by the upstream-side optical sensor 55, and the carry unit is controlled in accordance with the detection result. Thus, the information for controlling the carry unit can be detected with the suitable sensor.

(10-2) In the above-described embodiment, the printer 1 (printing apparatus) controls the carry unit 20 in accordance with the detection result of the upstream-side optical sensor 54 (first sensor). For example, the printer 1 carries the paper to the print start position in accordance with the detection result of the upstream-side optical sensor 54.

Thus, the upstream-side optical sensor 54 can detect the carry operation information that is necessary for the print operation at a location that is further upstream than the downstream-side optical sensor 55. That is to say, the present embodiment can detect the information used for the carry operation at a location that is better suited than the detection position in the comparative example of FIG. 32B.

(11-1) In the above-described embodiment, the head is controlled in accordance with the detection result of the upstream-side optical sensor 54 (first sensor). For example, the upstream-side optical sensor detects the lateral edges of the paper, and a lateral edge process is performed by controlling the head in accordance with the detection results. Thus, the information for controlling the head can be detected with the suitable sensor.

(11-2) In the above-described embodiment, the printer 1 (printing apparatus) controls the head 41 in accordance with the detection result of the upstream-side optical sensor 54 (first sensor). For example, the printer 1 performs the lateral edge process or the lower edge process in accordance with the detection result of the upstream-side optical sensor 54.

Thus, the upstream-side optical sensor 54 can detect the ink ejection operation information that is necessary for the print operation at a location that is further upstream than the downstream-side optical sensor 55. That is to say, the present embodiment can detect the information used for the ejection operation at a location that is better suited than the detection position in the comparative example of FIG. 32B.

(12-1) In the above-described embodiment, the upstream-side optical sensor 54 (first sensor) detects the lateral edges of the paper (medium), and the printer 1 (printing apparatus) detects the paper width from the detection result of the lateral edge, and replaces a portion of the print data with NULL data, in accordance with the detected paper width, thus determining the region onto which ink is ejected from the head 41.

Thus, the information that is necessary to determine the region onto which ink is ejected from the head can be detected with the upstream-side optical sensor 54, which is better suited for this than the downstream-side optical sensor 55. That is to say, in the present embodiment, the information for determining the region onto which ink is ejected from the head can be detected with the best suited sensor.

(12-2) In the above-described embodiment, the upstream-side optical sensor 54 (first sensor) detects the lateral edges of the paper (medium), and the printer 1 (printing apparatus) detects the paper width from the detection result of the lateral edge, and replaces a portion of the print data with NULL data, in accordance with the detected paper width, thus determining the region onto which ink is ejected from the head 41.

Thus, the upstream-side optical sensor 54 can detect the information that is necessary to determine the region onto which ink is ejected from the head at a position that is further upstream than the downstream-side optical sensor 55. That is to say, in the present embodiment, the information for determining the region onto which ink is ejected from the head can be detected at a position that is better suited than the detection position of the comparative example in FIG. 32B.

(13-1) In the above-described embodiment, the upstream-side optical sensor 54 (first sensor) detects the upper edge of the paper (medium), and the carry unit 20 carries the paper to the print start position, in accordance with the detection result of the upper edge.

Thus, the information that is necessary to carry the medium to the print start position can be detected with the upstream-side optical sensor 54, which is better suited for this than the downstream-side optical sensor 55. That is to say, in the present embodiment, the information necessary for carrying the medium to the print start position can be detected with the suitable sensor.

(13-2) In the above-described embodiment, the upstream-side optical sensor 54 (first sensor) detects the upper edge of the paper (medium), and the carry unit 20 carries the paper to the print start position, in accordance with the detection result of the upper edge.

Thus, the upstream-side optical sensor 54 can detect the information that is necessary to carry the medium to the print start position at a position that is further upstream than the downstream-side optical sensor 55. That is to say, in the present embodiment, the information necessary for carrying the medium to the print start position can be detected at a position that is better suited than the detection position of the comparative example in FIG. 32B.

(14-1) In the above-described embodiment, the upstream-side optical sensor 54 (first sensor) detects the lower edge of the medium, and the printer 1 (printing apparatus) determines the nozzles that are used in accordance with the detection result of the lower edge, thus determining the region on which ink is ejected from the head.

Thus, the information that is necessary to determine the region onto which ink is ejected from the head can be detected with the upstream-side optical sensor 54, which is better suited for this than the downstream-side optical sensor 55. That is to say, in the present embodiment, the information for determining the region onto which ink is ejected from the head can be detected with the optimal sensor.

(14-2) In the above-described embodiment, the upstream-side optical sensor 54 (first sensor) detects the lower edge of the medium, and the printer 1 (printing apparatus) determines the nozzles that are used in accordance with the detection result of the lower edge, thus determining the region on which ink is ejected from the head.

Thus, the upstream-side optical sensor 54 can detect the information that is necessary to determine the region onto which ink is ejected from the head at a position that is further upstream than the downstream-side optical sensor 55. That is to say, in the present embodiment, the information for determining the region onto which ink is ejected from the head can be detected at a position that is better suited than the detection position of the comparative example in FIG. 32B.

(15-1) In the above-described embodiment, the ejection test for the head 41 is carried out based on the detection result of the test pattern 71 and the test pattern 81 (patterns) with the downstream-side optical sensor 55 (second sensor).

Thus, the information for the ejection test can be detected by the downstream-side optical sensor 55, which is better suited for this than the upstream-side optical sensor 54. That is to say, in the present embodiment, the information used for the ejection test can be detected with the suitable sensor.

(15-2) In the above-described embodiment, the ejection test for the head 41 is carried out based on the detection result of the test pattern 71 and the test pattern 81 (patterns) with the downstream-side optical sensor 55 (second sensor).

Thus, the downstream-side optical sensor 55 can detect the information for the ejection test at a position that is further downstream then the upstream-side optical sensor 54. That is to say, the present embodiment can detect the information used for the ejection test at a location that is better suited than the detection position in the comparative example of FIG. 32A.

(16-1) In the above-described embodiment, the process of cleaning of the head 41 is carried out in accordance with the detection result of the downstream-side optical sensor 55 (second sensor). Thus, clogging of the nozzles can be prevented.

However, the operations performed in accordance with the ejection test are not limited to the cleaning process. For example, if non-ejecting nozzles are detected as a result of the ejection test, then it is also possible to display a warning for the user.

(16-2) In the above-described embodiment, the process of cleaning of the head 41 is carried out in accordance with the detection result of the downstream-side optical sensor 55 (second sensor). Thus, clogging of the nozzles can be prevented.

However, the operations performed in accordance with the ejection test are not limited to the cleaning process. For example, if non-ejecting nozzles are detected as a result of the ejection test, then it is also possible to display a warning for the user.

(17-1) In the present embodiment, the head 41 can eject ink while it moves in forward passes and return passes along the scanning direction. Then, the printer 1 detects the correction pattern with the downstream-side optical sensor 55, and in accordance with the detection result of the downstream-side optical sensor 55 (second sensor), determines the locations onto which ink is ejected from the head (see FIG. 29 and FIGS. 30A to 30C).

Thus, the information for determining the ink ejection locations while moving the head in the forward passes and the return passes can be detected with the downstream-side optical sensor 55, which is better suited for this than the upstream-side optical sensor 54. That is to say, in the present embodiment, the information used for determining the ejection locations can be detected with the suitable sensor.

(17-2) In the present embodiment, the head 41 can eject ink while it moves in forward passes and return passes along the scanning direction. Then, the printer 1 detects the correction pattern with the downstream-side optical sensor 55, and in accordance with the detection result of the downstream-side optical sensor 55 (second sensor), determines the locations onto which ink is ejected from the head (see FIG. 29 and FIGS. 30A to 30C).

Thus, the downstream-side optical sensor 55 can detect the information for determining the ink ejection locations while moving the head in the forward passes and the return passes at a position that is further downstream than the upstream-side optical sensor 54. That is to say, the present embodiment can detect the information used for determining the ejection locations at a position that is better suited than the detection position in the comparative example of FIG. 32A.

(18-1) In the above-described embodiment, the type of the paper (medium) is detected from the detection result of the upstream-side optical sensor 54 (first sensor) and the detection result of the downstream-side optical sensor 55 (second sensor).

Thus, in this embodiment, two different sensors are provided at different positions in the carrying direction, but these two sensors can be used to detect one feature.

(18-2) In the above-described embodiment, the type of the paper (medium) is detected from the detection result of the upstream-side optical sensor 54 (first sensor) and the detection result of the downstream-side optical sensor 55 (second sensor).

Thus, in this embodiment, two different sensors are provided at different positions in the carrying direction, but these two sensors can be used to detect one feature.

(19-1) In the above-described embodiment, the head 41 performs printing (recording) on the medium while controlling for example the ink amount ejected from the head 41 in accordance with the type of the paper (medium). Thus, printing is optimized with regard to the paper type.

However, the information relating to the detected paper type can also be used for other purposes than for controlling the printing. For example, when the detected paper type differs from the paper type of the print instructions, then it is possible to display a warning for the user.

(19-2) In the above-described embodiment, the head 41 performs printing (recording) on the medium while controlling for example the ink amount ejected from the head 41 in accordance with the type of the paper (medium). Thus, printing is optimized with regard to the paper type.

However, the information relating to the detected paper type can also be used for other purposes than for controlling the printing. For example, when the detected paper type differs from the paper type of the print instructions, then it is possible to display a warning for the user.

INDUSTRIAL APPLICABILITY

With the present invention, it is possible to increase the number of features than can be detected, without slowing down the operations before and after detection and without reducing the detection precision.

Moreover, with the present invention, the features to be detected can be split by providing two movable sensors.

The invention claimed is:

1. A printing apparatus, comprising:

a transport unit that transports a medium in a transporting direction;

a head that performs recording on a medium using ink and that moves in a moving direction;

a first sensor that moves in said moving direction together with said head and that detects an edge of said medium; and a second sensor that moves in said moving direction together with said head and that detects a pattern formed on said medium by said head;

wherein:

said first sensor is provided further upstream with regard to said transporting direction than said second sensor, said head has a plurality of colored-liquid nozzles that eject a colored liquid and a plurality of colorless-liquid nozzles that eject a colorless liquid, each of said plurality of colored-liquid nozzles respectively forms a colored block pattern on said medium, a plurality of the colored block patterns are formed on said medium lined up in a straight line in said moving direction and leaving no space between the colored block patterns adjacent to one another, said plurality of the colored block patterns constituting a group of tested colored block patterns to be subjected to testing, said second sensor detects said tested colored block patterns that are lined up in said moving direction while moving once in said moving direction in order to test whether there is a colored-liquid nozzle that has not ejected said colored liquid, said group of tested colored block patterns is surrounded by a non-tested pattern that is not subjected to testing by said second sensor, each of said plurality of colorless-liquid nozzles respectively forms a colorless block pattern on said medium, a plurality of the colorless block patterns are formed on said medium lined up in a straight line in said moving direction and leaving a space between the colorless block patterns adjacent to one another, said plurality of colored-liquid nozzles apply said colored liquid onto said plurality of the colorless block patterns, and said second sensor detects, while moving once in said moving direction, a degree of smearing of said colored liquid at a position where said colorless block pattern is to be formed in order to detect whether there is a colorless-liquid nozzle that has not ejected said colorless liquid.

2. A printing apparatus as set forth in claim 1, wherein:

the first sensor detects regular reflection light from said medium; and the second sensor is provided separately from said first sensor, and detects diffuse reflection light from said medium.

3. A printing apparatus according to claim 1, wherein said head can eject said ink while moving in a forward pass and in a return pass; and locations at which ink is to be ejected from said head are determined in accordance with the detection result of said second sensor.

4. A printing apparatus according to claim 1, wherein the type of said medium is detected from the detection result of said first sensor and the detection result of said second sensor.

5. A printing apparatus according to claim 4, wherein said head performs the recording on said medium in accordance with the type of said medium.

6. The printing apparatus according to claim 1, wherein:

said first sensor includes a light-emitting section and a light-receiving section;

said second sensor includes a light-emitting section and a light-receiving section; and a direction in which said light-emitting section and said light-receiving section of said first sensor are arranged is different from a direction in which said light-emitting section and said light-receiving section of said second sensor are arranged.

7. A printing apparatus according to claim 6, wherein said light-emitting section and said light-receiving section of said first sensor are arranged in said transporting direction; and said light-emitting section and said light-receiving section of said second sensor are arranged in said moving direction.

8. A printing apparatus according to claim 1, wherein said first sensor includes a light-emitting section and a light-receiving section;

said light-emitting section of said first sensor irradiates light onto said medium; and said light-receiving section of said first sensor receives regular reflection light from said medium.

9. A printing apparatus according to claim 1, wherein said second sensor includes a light-emitting section and a light-receiving section;

said light-emitting section of said second sensor irradiates light onto said medium; and said light-receiving section of said second sensor receives diffuse reflection light from said medium.

10. A printing apparatus according to claim 1, wherein said transport unit is controlled in accordance with the detection result of said first sensor.

11. A printing apparatus according to claim 1, wherein said head is controlled in accordance with the detection result of said first sensor.

12. A printing apparatus according to claim 1, wherein said first sensor detects a lateral edge of said medium; and a region onto which ink is to be ejected from said head is determined in accordance with the result of detecting said lateral edge.

13. A printing apparatus according to claim 1, wherein said first sensor detects an upper edge of said medium; and said transport unit transports said medium to a print start position in accordance with the result of detecting said upper edge.

14. A printing apparatus according to claim 1, wherein said first sensor detects a lower edge of said medium; and a region onto which ink is to be ejected from said head is determined in accordance with the result of detecting said lower edge.

15. A printing apparatus according to claim 1, wherein an ejection test of said head is performed in accordance with the result of detecting said pattern with said second sensor.

16. A printing apparatus according to claim 1, wherein said head can eject said ink while moving in a forward pass and in a return pass; and locations at which ink is to be ejected from said head are determined in accordance with the detection result of said second sensor.

17. A printing apparatus according to claim 15, wherein said transport unit is controlled in accordance with the detection result of said first sensor.

18. A printing apparatus according to claim 1, wherein the type of said medium is detected from the detection result of said first sensor and the detection result of said second sensor.

19. A printing apparatus according to claim 18, wherein said head performs the recording on said medium in accordance with the type of said medium.

20. A printing system comprising:

a computer; and a printing apparatus, said printing apparatus including:

a transport unit that transports a medium in a transporting direction;

a head that performs recording on a medium using ink and that moves in a moving direction;

a first sensor that moves in said moving direction together with said head and that detects an edge of said medium; and a second sensor that moves in said moving direction together with said head and that detects a pattern formed on said medium by said head;

wherein:

said first sensor is provided further upstream with regard to said transporting direction than said second sensor, said head has a plurality of colored-liquid nozzles that eject a colored liquid and a plurality of colorless-liquid nozzles that eject a colorless liquid, each of said plurality of colored-liquid nozzles respectively forms a colored block pattern on said medium, a plurality of the colored block patterns are formed on said medium lined up in a straight line in said moving direction and leaving no space between the colored block patterns adjacent to one another, said plurality of the colored block patterns constituting a group of tested colored block patterns to be subjected to testing, said second sensor detects said tested colored block patterns that are lined up in said moving direction while moving once in said moving direction in order to test whether there is a colored-liquid nozzle that has not ejected said colored liquid, said group of tested colored block patterns is surrounded by a non-tested pattern that is not subjected to testing by said second sensor, each of said plurality of colorless-liquid nozzles respectively forms a colorless block pattern on said medium, a plurality of the colorless block patterns are formed on said medium lined up in a straight line in said moving direction and leaving a space between the colorless block patterns adjacent to one another, said plurality of colored-liquid nozzles apply said colored liquid onto said plurality of the colorless block patterns, and said second sensor detects, while moving once in said moving direction, a degree of smearing of said colored liquid at a position where said colorless block pattern is to be formed in order to detect whether there is a colorless-liquid nozzle that has not ejected said colorless liquid.

21. A printing system as set forth in claim 20, wherein:

the first sensor detects regular reflection light from said medium; and the second sensor is provided separately from said first sensor, and detects diffuse reflection light from said medium.

* * * * *